US012330840B2

(12) United States Patent
Sekowski et al.

(10) Patent No.: US 12,330,840 B2
(45) Date of Patent: Jun. 17, 2025

(54) COLLAPSIBLE CRATE WITH RETRACTABLE WALL

(71) Applicant: Rehrig Pacific Company, Los Angeles, CA (US)

(72) Inventors: Daniel Vincent Sekowski, Loganville, GA (US); Travis James Englert, Brea, CA (US); Jon P. Hassell, Atlanta, GA (US); William P. Apps, Alpharetta, GA (US)

(73) Assignee: Rehrig Pacific Company, Monterey Park, CA (US)

( * ) Notice: Subject to any disclaimer, the term of this patent is extended or adjusted under 35 U.S.C. 154(b) by 818 days.

(21) Appl. No.: 16/781,511

(22) Filed: Feb. 4, 2020

(65) Prior Publication Data

US 2020/0247583 A1 Aug. 6, 2020

Related U.S. Application Data

(60) Provisional application No. 62/801,060, filed on Feb. 4, 2019.

(51) Int. Cl.
*B65D 21/08* (2006.01)
*B65D 6/18* (2006.01)
(Continued)

(52) U.S. Cl.
CPC ..... *B65D 21/086* (2013.01); *B65D 11/1833* (2013.01); *B65D 11/184* (2013.01);
(Continued)

(58) Field of Classification Search
CPC ..... B65D 21/086; B65D 21/0209; B65D 25/005; B65D 85/32; B65D 11/18;
(Continued)

(56) References Cited

U.S. PATENT DOCUMENTS 853,099 A 5/1907 Livingstone
4,630,746 A * 12/1986 Fortenberry ..... B65D 19/18 220/6
(Continued)

FOREIGN PATENT DOCUMENTS

CA 2316423 A1 * 5/2001 ..... B65D 11/1833
CA 2327942 A1 * 6/2001 ..... B65D 11/1833
(Continued)

OTHER PUBLICATIONS

Snap-Fit Joints for Plastics; Bayer MaterialScience.
Polymer Logistics Egg Crate, Jan. 2018.

*Primary Examiner* — Shawn M Braden
(74) *Attorney, Agent, or Firm* — Carlson, Gaskey & Olds, P.C.

(57) ABSTRACT

The collapsible container includes a base and a pair of opposed first walls pivotably connected to opposed first edges of the base. A second wall or front wall is pivotably connected to a second edge of the base such that the second wall is perpendicular to the first walls. The front wall includes a frame including a pair of elongated vertical upstanding members each including a recess opening outward of the container. The front wall further includes a door pivotably connected to the upstanding members. The door includes an upper panel portion having a pair of wing portions projecting away from one another and receivable in the recesses in the upstanding members.

28 Claims, 37 Drawing Sheets

(51) Int. Cl.
*B65D 21/02* (2006.01)
*B65D 25/00* (2006.01)
*B65D 85/32* (2006.01)

(52) U.S. Cl.
CPC ..... *B65D 21/0209* (2013.01); *B65D 25/005* (2013.01); *B65D 85/32* (2013.01)

(58) Field of Classification Search
CPC ..... B65D 11/1806; B65D 11/1813; B65D 11/182; B65D 11/1826; B65D 11/1833; B65D 11/184; B65D 11/1846; B65D 11/1853; B65D 11/186; B65D 2501/24171; B65D 2501/24006; B65D 90/02; B65D 7/12; B65D 2519/00805; B65D 2519/00601; B65D 2519/00611; B65D 2519/00577; B65D 2519/00582; B65D 2519/00587; B65D 2519/00592; B65D 2519/00597; B65D 2519/00606; B65D 2519/00621; B65D 2519/00626; B65D 2519/0052
See application file for complete search history.

(56) References Cited

U.S. PATENT DOCUMENTS 4,674,647 A * 6/1987 Gyenge ..... B65D 19/18 220/6
4,756,420 A 7/1988 Deaton
4,917,255 A * 4/1990 Foy ..... B65D 25/005 220/691
4,923,079 A * 5/1990 Foy ..... B65D 19/18 220/326
5,161,709 A * 11/1992 Oestreich, Jr. ..... B65D 19/12 220/1.5
5,199,592 A * 4/1993 Reiland ..... B65D 11/1833 16/366
5,586,675 A * 12/1996 Borsboom ..... B65D 11/1833 220/6
5,588,549 A * 12/1996 Furtner ..... B65D 11/1833 220/691
5,601,202 A * 2/1997 Meacham ..... B65D 11/1833 220/4.31
5,632,392 A * 5/1997 Oh ..... B65D 11/1833 220/6
5,681,066 A * 10/1997 Anderson ..... E05C 1/166 292/33
5,722,328 A 3/1998 Darby
5,853,099 A 12/1998 Lessard
6,290,081 B1 * 9/2001 Merey ..... B65D 11/1833 220/7
6,293,418 B1 9/2001 Ogden et al.
6,488,168 B1 * 12/2002 Wang ..... B60R 7/02 220/6
6,601,724 B1 8/2003 Koefelda et al.
6,669,044 B2 12/2003 Murakami et al.
6,772,897 B2 8/2004 Kellerer et al.
6,874,637 B2 4/2005 Pigott et al.
7,011,225 B2 3/2006 Oster et al.
7,159,730 B2 * 1/2007 Rumpel ..... B65D 11/1833 220/23.6
7,195,128 B2 * 3/2007 Murakami ..... B65D 11/1833 206/600
7,264,122 B2 9/2007 Koefelda et al.
7,311,220 B2 12/2007 Kellerer
7,370,771 B2 5/2008 Rader
7,416,092 B2 8/2008 Dubois et al.
7,428,973 B2 9/2008 Barth et al.
7,484,634 B2 2/2009 Apps
7,677,434 B2 3/2010 Fry
RE41,323 E 5/2010 Kellerer et al.
7,780,067 B2 8/2010 Holley, Jr.
7,784,631 B2 8/2010 Winn et al.
7,828,167 B2 11/2010 Nolan
7,861,878 B2 1/2011 Escarpa Gil
7,896,142 B2 3/2011 Vanhees
7,896,184 B2 * 3/2011 Meers ..... B65D 25/005 220/666
8,066,147 B2 11/2011 Meers et al.
8,109,402 B2 2/2012 Hartwall
8,348,076 B2 1/2013 Rader et al.
8,413,831 B2 4/2013 Nolan
8,434,618 B2 5/2013 Mitchell et al.
8,469,216 B2 6/2013 Pils
8,511,496 B2 * 8/2013 Van Der Korput .... B65D 19/06 220/666
8,646,639 B2 * 2/2014 Pils ..... B65D 11/1833 220/7
8,757,412 B2 6/2014 Sommer et al.
8,807,367 B2 8/2014 Bobritski
8,863,971 B2 * 10/2014 Cavalcante ..... B65D 88/52 220/4.28
9,278,775 B2 3/2016 Meers et al.
9,327,041 B2 * 5/2016 Hawkes ..... A61L 2/26
9,422,087 B1 8/2016 Poran et al.
9,475,638 B2 10/2016 Cavalcante et al.
9,745,100 B2 * 8/2017 Baltz ..... B65D 21/086
10,167,660 B2 1/2019 Ficker
2002/0130167 A1 9/2002 Riedi
2002/0134823 A1 9/2002 Riedi
2003/0127456 A1 * 7/2003 Brown ..... B65D 19/12 220/4.33
2003/0146213 A1 8/2003 Kellerer et al.
2003/0213835 A1 11/2003 Riedi
2004/0129700 A1 7/2004 Oster et al.
2004/0178197 A1 * 9/2004 Hsu ..... B65D 11/1833 220/7
2005/0098556 A1 5/2005 Kellerer
2005/0230464 A1 10/2005 Riedi
2006/0237456 A1 * 10/2006 McDade ..... B65D 11/1826 220/6
2007/0075077 A1 4/2007 Dubois et al.
2007/0125779 A1 6/2007 Cope
2008/0142530 A1 * 6/2008 Meers ..... B65D 85/32 220/666
2009/0057320 A1 3/2009 Meers et al.
2009/0084784 A1 4/2009 Sabanci
2009/0101640 A1 * 4/2009 Hadar ..... B65D 11/1833 220/7
2009/0114647 A1 * 5/2009 Apps ..... B65D 21/062 220/6
2009/0205169 A1 8/2009 Nolan et al.
2009/0308866 A1 12/2009 Elvin-Jensen et al.
2010/0230406 A1 * 9/2010 Yamauchi ..... B65D 11/1833 220/7
2010/0287858 A1 11/2010 Israeli et al.
2010/0294757 A1 11/2010 Pils
2011/0139775 A1 6/2011 Nolan
2011/0240637 A1 10/2011 Orgeldinger
2011/0290811 A1 * 12/2011 Koefelda ..... B65D 11/1833 220/666
2012/0037647 A1 * 2/2012 Cook ..... B65D 11/1833 220/666
2013/0001223 A1 * 1/2013 Cavalcante ..... B65D 25/30 220/660
2013/0175265 A1 6/2013 Sommer et al.
2013/0193153 A1 * 8/2013 Baltz ..... B65D 11/1833 220/666
2014/0144909 A1 * 5/2014 Bobritski ..... B65D 25/30 220/7
2014/0251992 A1 * 9/2014 Cavalcante ..... B65D 11/184 220/4.29
2016/0236818 A1 8/2016 Poran et al.
2016/0340091 A1 * 11/2016 Jian ..... B65D 25/005
2017/0074017 A1 * 3/2017 Ficker ..... B65D 19/18
2017/0137175 A1 * 5/2017 Park ..... B65D 25/30
2018/0002063 A1 * 1/2018 Su ..... B65D 7/26

(56) References Cited

U.S. PATENT DOCUMENTS

| | | | | |
|---|---|---|---|---|
| 2019/0092529 | A1* | 3/2019 | Su | B65D 25/005 |
| 2020/0122885 | A1* | 4/2020 | Dent | B65D 19/18 |

FOREIGN PATENT DOCUMENTS

| | | | | | |
|---|---|---|---|---|---|
| CA | 2330996 | A1 * | 7/2002 | B65D 11/1833 |
| CA | 2682832 | A1 * | 8/2003 | B65D 11/1833 |
| DE | 2063096 | A1 * | 6/1972 | B65D 19/08 |
| DE | 4422278 | A1 * | 3/1995 | B65D 11/1826 |
| DE | 10208846 | A1 * | 9/2003 | B65D 11/1833 |
| EP | 0505585 | A1 * | 9/1992 | B65D 21/062 |
| EP | 0685403 | A1 * | 12/1995 | F16B 5/0614 |
| EP | 1391389 | A2 * | 2/2004 | B65D 19/06 |
| EP | 2062827 | A1 * | 5/2009 | B65D 11/184 |
| FR | 1227059 | A * | 8/1960 | B65D 19/12 |
| FR | 2267948 | A1 * | 11/1975 | B65D 19/08 |
| FR | 2686118 | A1 * | 7/1993 | E05C 1/10 |
| GB | 2449502 | A * | 11/2008 | B65D 11/1833 |
| GB | 2476056 | A | 6/2011 | |
| WO | WO-9411259 | A1 * | 5/1994 | B65D 11/1833 |
| WO | WO-0029294 | A2 * | 5/2000 | B65D 11/1833 |
| WO | WO-2004014748 | A1 * | 2/2004 | B65D 19/06 |
| WO | WO-2005102852 | A1 * | 11/2005 | B65D 19/18 |
| WO | WO-2008094131 | A2 * | 8/2008 | B65D 11/1833 |
| WO | WO-2009153693 | A1 * | 12/2009 | B65D 11/1833 |
| WO | WO-2010031514 | A1 * | 3/2010 | B65D 19/06 |
| WO | WO-2012107088 | A1 * | 8/2012 | B65D 1/243 |

* cited by examiner

10

10

10

COLLAPSIBLE CRATE WITH RETRACTABLE WALL

BACKGROUND

The present invention relates generally to containers and more particularly to a crate that is particularly useful for transporting egg cartons or other items to a store.

Currently, grocery items, such as egg cartons, may be shipped to stores in metal crates. The crates must be unloaded onto shelves for the customers to select and purchase. This requires labor for handling the grocery items in the store.

SUMMARY

A collapsible container disclosed herein permits grocery items to be delivered to a store such that customers can conveniently select items directly from the container.

The collapsible container includes a base and a pair of opposed first walls pivotably connected to opposed first edges of the base. A second wall or front wall is pivotably connected to a second edge of the base such that the second wall is perpendicular to the first walls. The front wall includes a frame including a pair of elongated vertical upstanding members each including a recess opening outward of the container. The front wall further includes a door pivotably connected to the upstanding members. The door includes an upper panel portion having a pair of wing portions projecting away from one another and receivable in the recesses in the upstanding members.

The door may include a pair of arms extending downward from the upper panel portion and pivotably secured to the upstanding members.

The door may include a pair of latches biased away from each other. The latches may be released from the upstanding members upon movement of the latches toward one another.

The latches may each include at least one resilient leg biasing an interlocking portion toward one of the upstanding members.

DETAILED DESCRIPTION

Figure 1:
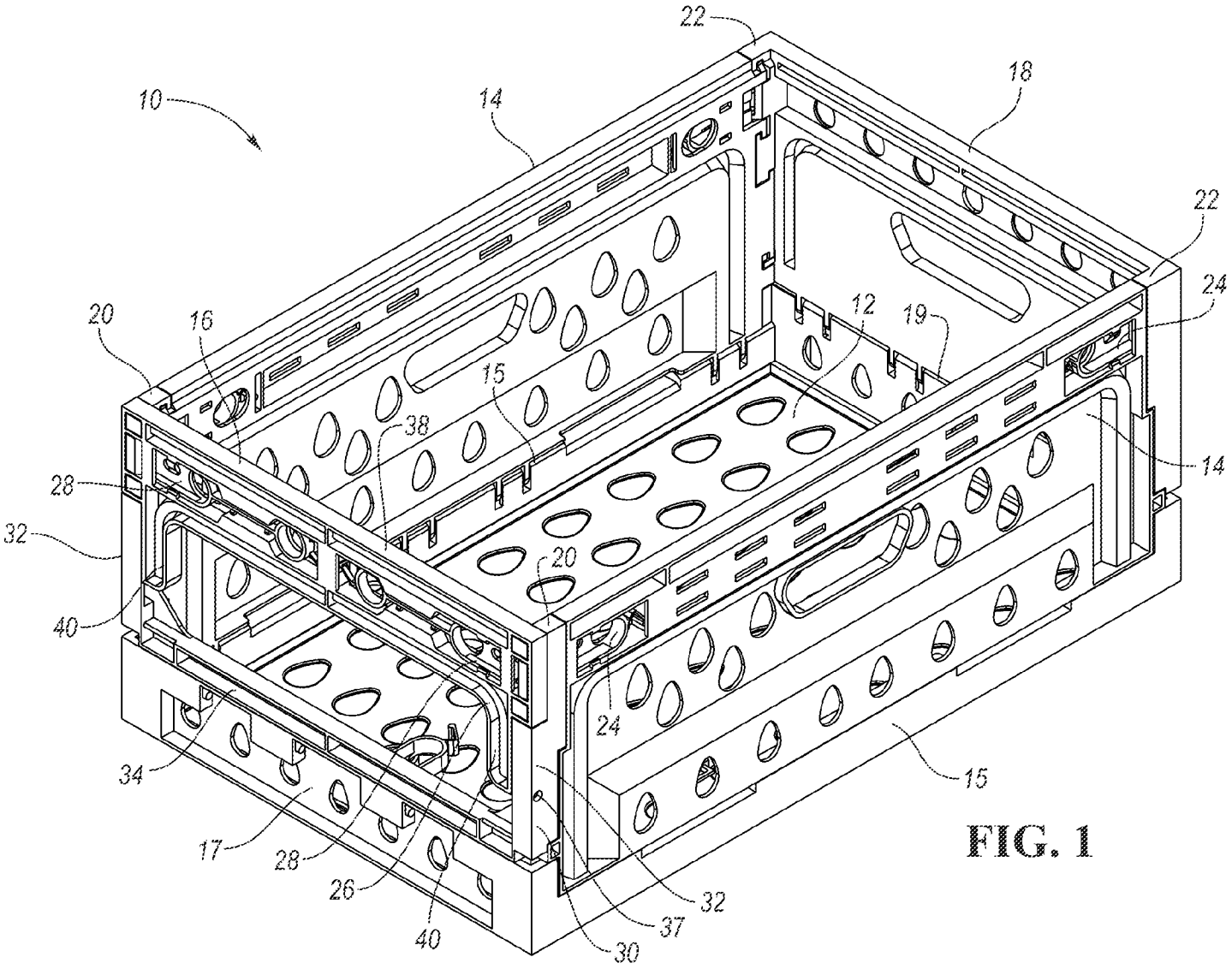
FIG. 1 is a perspective view of a collapsible crate according to one embodiment.

A collapsible crate 10 is shown in FIG. 1. The crate 10 includes a base 12 having upstanding side flanges 15 and upstanding front flange 17 and an upstanding rear flange 19. Side walls 14 are pivotably connected to the side flanges 15. A front wall 16 is pivotably connected to the front flange 17. A rear wall 18 is pivotably connected to the rear flange 19. In this example, the front flange 17 and rear flange 19 are taller than the side flanges 15, so that the front wall 16 and rear wall 18 can fold onto the side walls 14 in the collapsed position. Alternatively, the walls 14, 16, 18 could be reconfigured such that the front and rear walls 16, 18 fold down onto the base prior to the side walls 14. The walls 14, 16, 18, all extend to approximately the same height above the base 12; however preferably, the side walls 14 are substantially longer than the front and rear walls 16, 18.

The front wall 16 has a pair of flanges 20 projecting rearwardly from side edges thereof. Similarly, the rear wall 18 has a pair of flanges 22 projecting forwardly thereof. Latches 24 selectively connect the side walls 14 to the flanges 20, 22 of the front wall 16 and rear wall 18.

The front wall 16 includes a door 26 pivotably connected to a frame 30 and selectively held in place in the upright, extended, closed position shown in FIG. 1 by a pair of latches 28. As will be described in more detail below, the latches 28 selectively secure the door 26 in the upright position to the frame 30. The frame 30 includes a pair of elongated vertical upstanding members 32 at opposite ends of a lower bar 34, thereby creating a U-shaped frame 30. The U-shaped frame 30 defines an opening into the crate 10, which is partially closed by the door 26 in the closed position as shown in FIG. 1. The door 26 includes an upper panel portion 38 extending between a pair of arms 40 extending downward (downward relative to FIG. 1) from sides of the upper panel portion 38. A pair of hinges 37 hingably connect lower ends of the arms 40 to the upstanding members 32.

Figure 2:
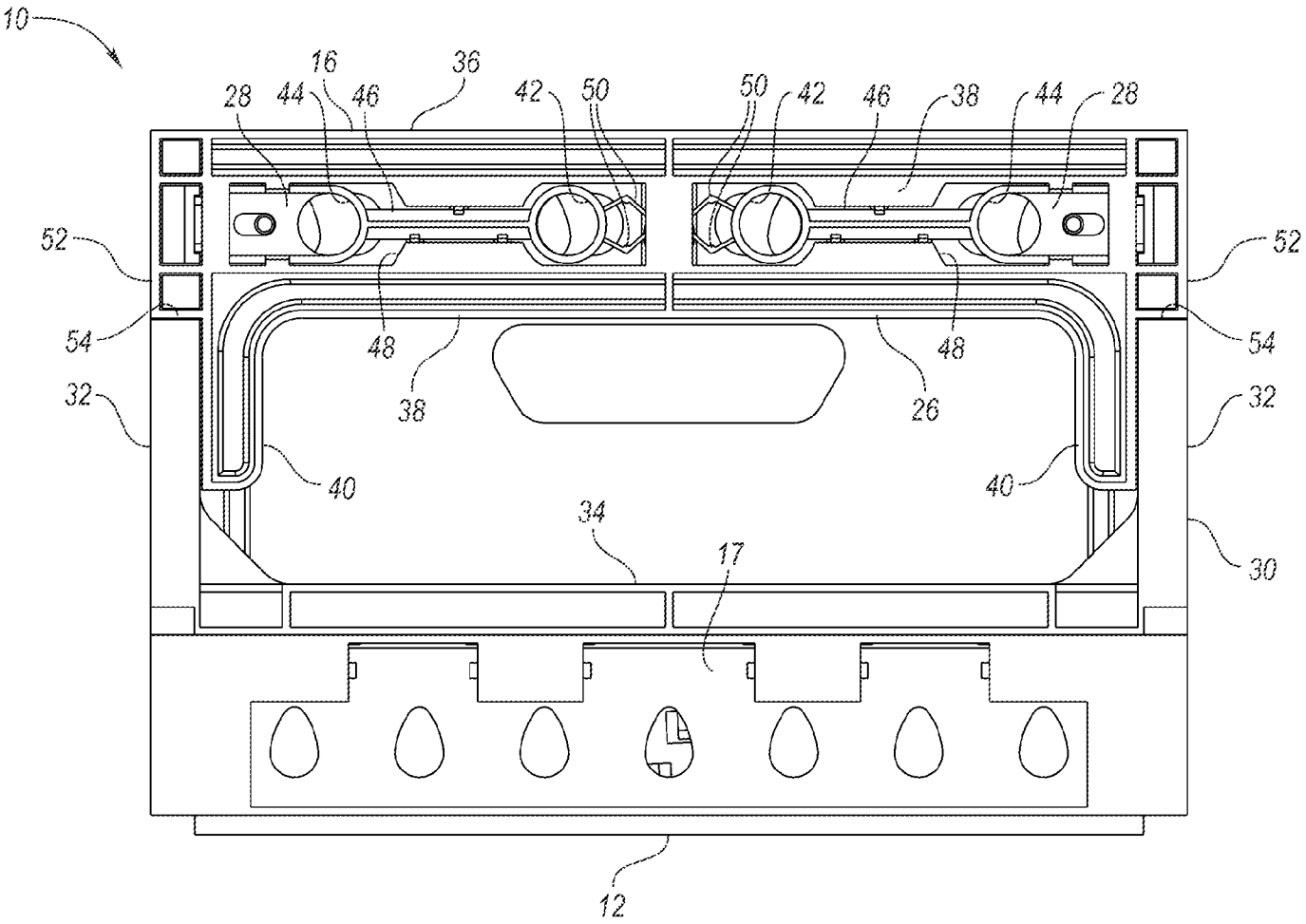
FIG. 2 is an end view of the crate of FIG. 1.

FIG. 2 is a front view of the crate 10 of FIG. 1. Each of the latches 28 includes an inner handle portion 42 or inner loop and an outer handle portion 44 or outer loop connected by a connecting rod 46. Each latch 28 is slidably captured in a channel 48 in the upper panel portion 38 of the door 26. Each latch 28 includes a pair of resilient legs 50 or springs biasing each latch 28 outward from a center of the upper panel portion 38. The pair of resilient legs 50 is integrally molded with the rest of the latch 28.

The upper panel portion 38 of the door 26 includes a pair of wing portions 52 that project away from one another into a recess 54 formed in the upstanding members 32 of the frame 30. As shown more clearly in FIG. 1, the wing portions 52 of the door 26 extend outwardly into the planes containing and parallel to the side walls 14. The latches 28 can be released with one hand by squeezing the two inner handle portions 42 toward one another, or with two hands by using the outer handle portions 44. The door 26 can then pivot downward on the hinges 37 to a retracted, open position, as shown in FIG. 3.

Figure 3:
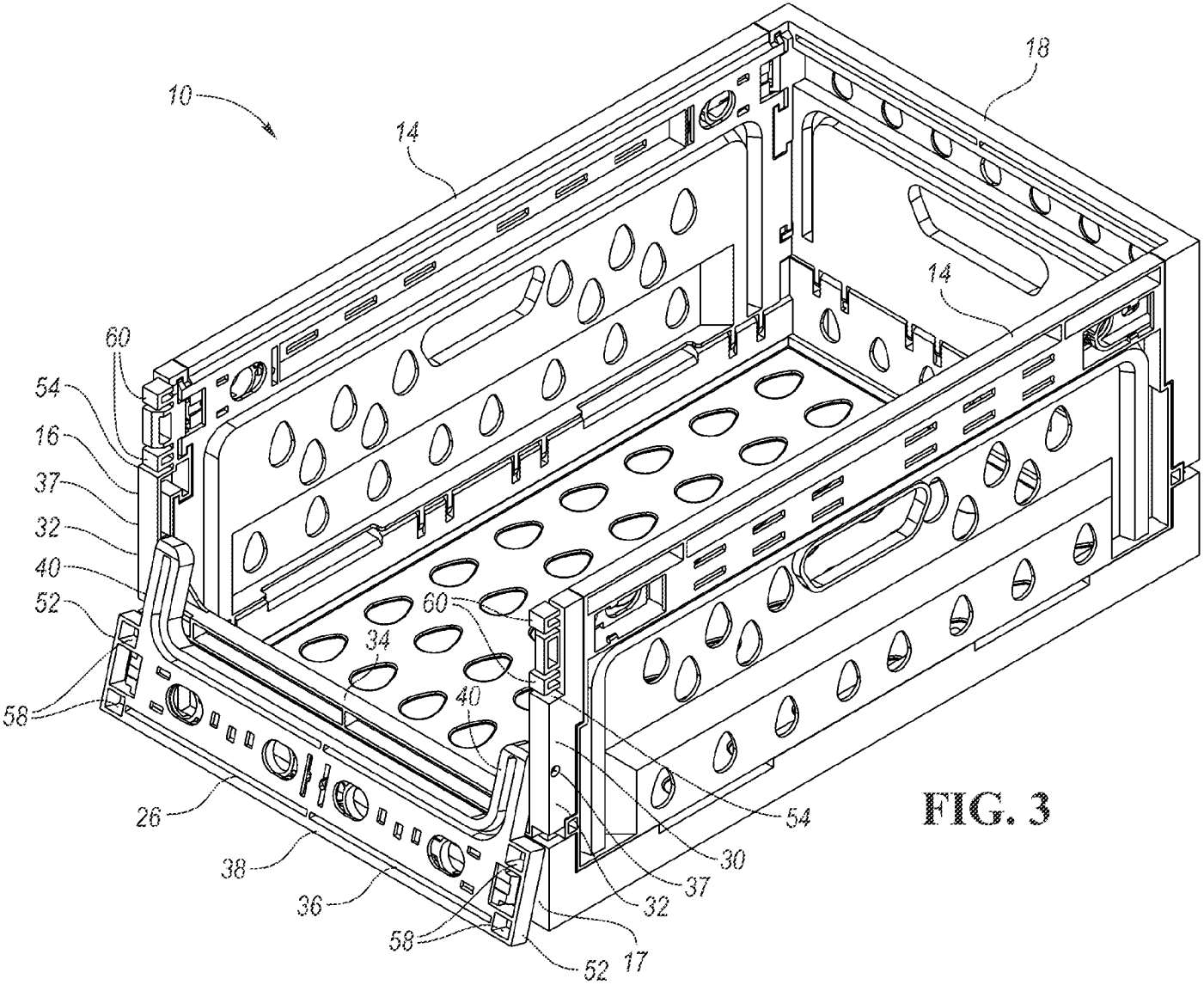
FIG. 3 shows the crate of FIG. 1 with the door pivoted to the open position.
Figure 4:
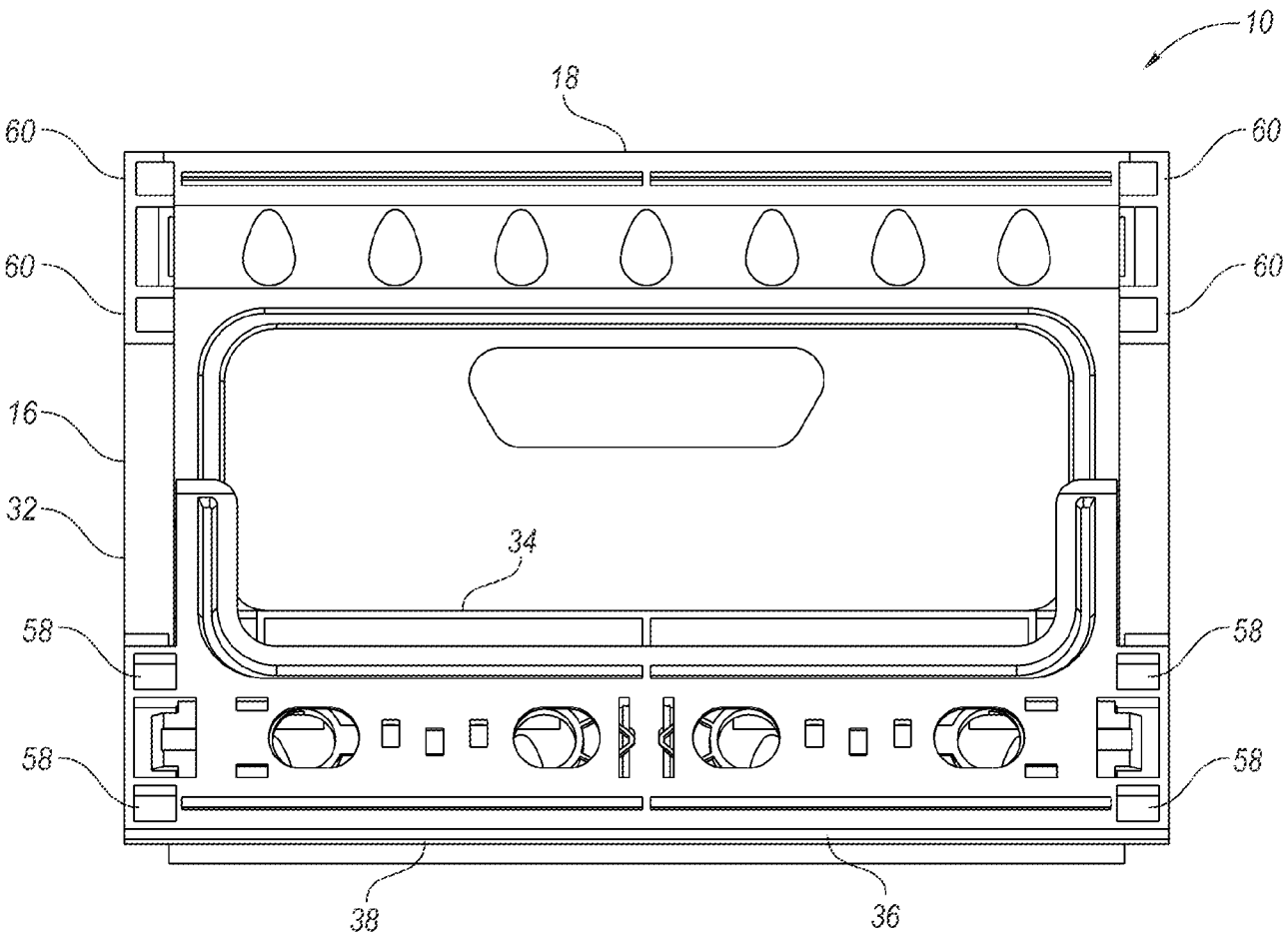
FIG. 4 is an end view of the crate of FIG. 1.

FIG. 3 shows the crate 10 with the door 26 pivoted downward to the retracted or open position. The door 26 is pivoted downward on the hinges 37 such that the upper panel portion 38 is adjacent the front flange 17 and the cross bar 34 of the frame 30. In this example, the upper panel portion 38 is completely below the upper edge of the cross bar 34 of the frame 30 (i.e. not blocking the opening through the front wall 16). When the door 26 is pivoted downward to this retracted position, access through the front of the crate 10 is greatly increased. Above the door 26, the upstanding members 32 do not project into the opening more than the side walls 14, as is also shown in FIG. 4. The upstanding members 32 are the same thickness as the side walls 14.

As shown in FIGS. 3 and 4, the upstanding members 32 of the frame 30 above the recess 54 each include a pair of interlocking projections 60 projecting forwardly to be aligned with complementary recesses 58 opening rearwardly of the wing portions 52 of the upper panel portion 38 of the door 26. When the door 26 is pivoted upward to the closed position (FIG. 1) the projection 60 are received in the recesses 58.

Figure 5:
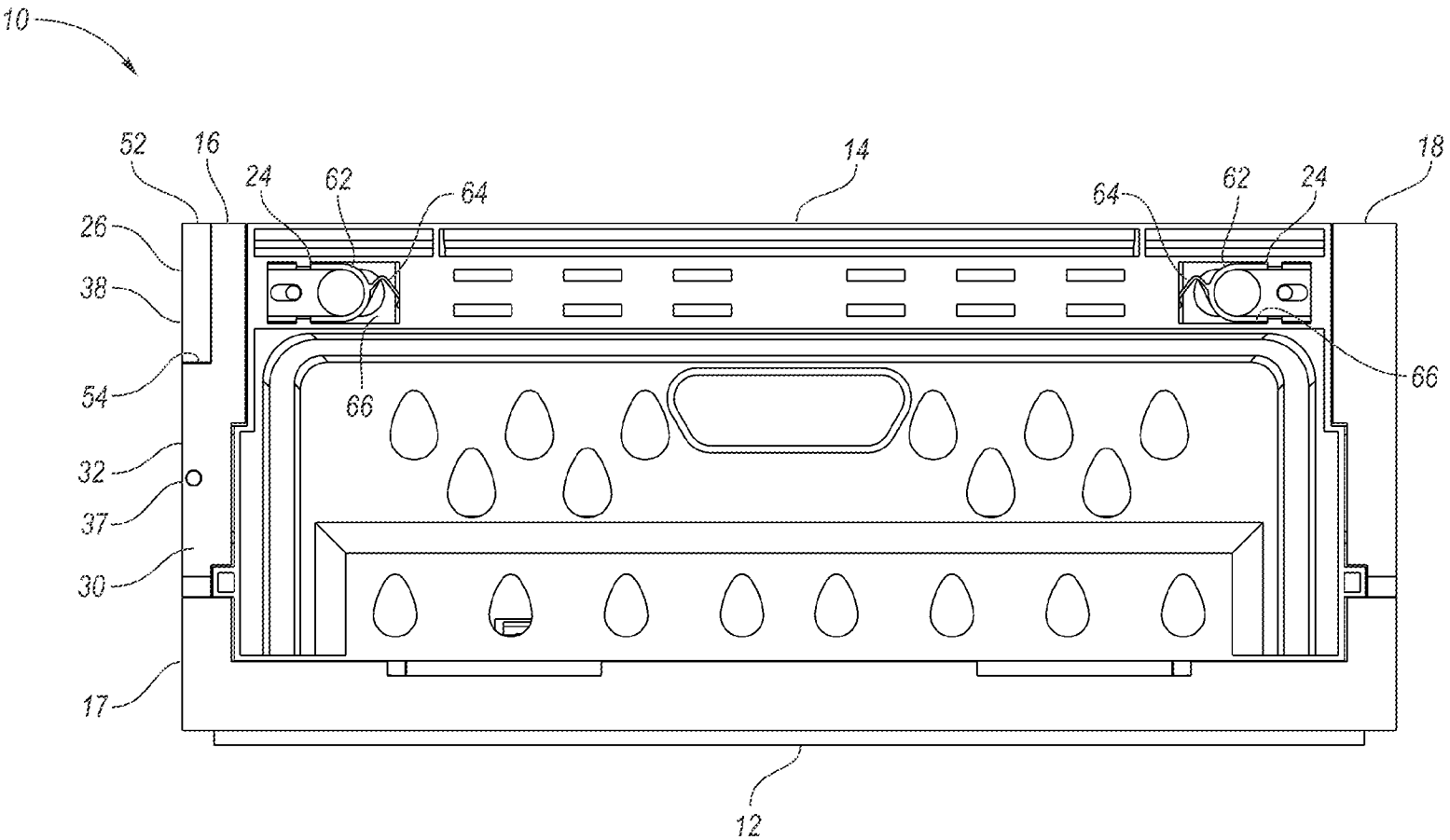
FIG. 5 is a side view of the crate of FIG. 1.

FIG. 5 is a side view of the crate 10. Each wing portion 52 is received in the recess 54 of the upstanding member 32 of the frame 30 on the front wall 16. Each of the latches 24 in each side wall 14 is biased outward (i.e. forward and rearward) toward the front wall 16 and toward the rear wall 18. Each latch 24 includes a handle portion 62 or loop and is slidably captured in a recess 66.

Figure 6:
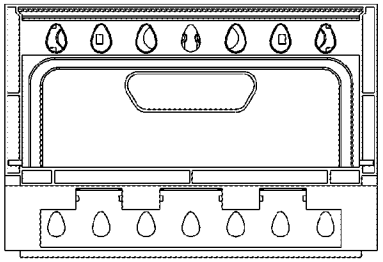
FIG. 6 is a rear view of the crate of FIG. 1.
Figure 8:
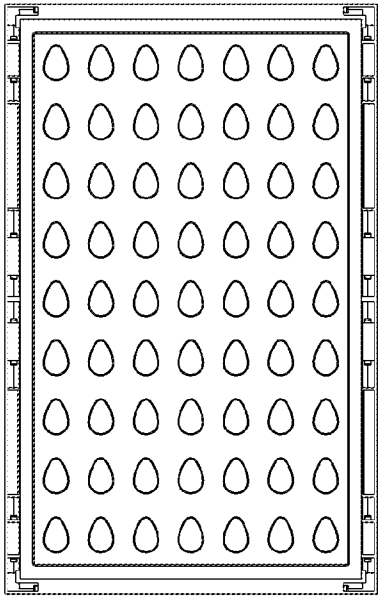
FIG. 8 is a bottom view of the crate of FIG. 1.
Figure 7:
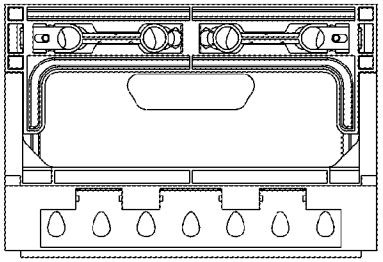
FIG. 7 is a top view of the crate of FIG. 1.
Figure 7:
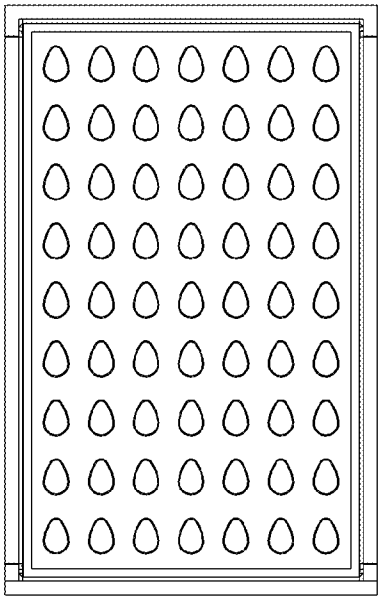

FIG. 6 is a rear view of the crate 10. FIG. 7 is a top view of the crate 10. FIG. 8 is a bottom view of the crate 10.

Figure 9:
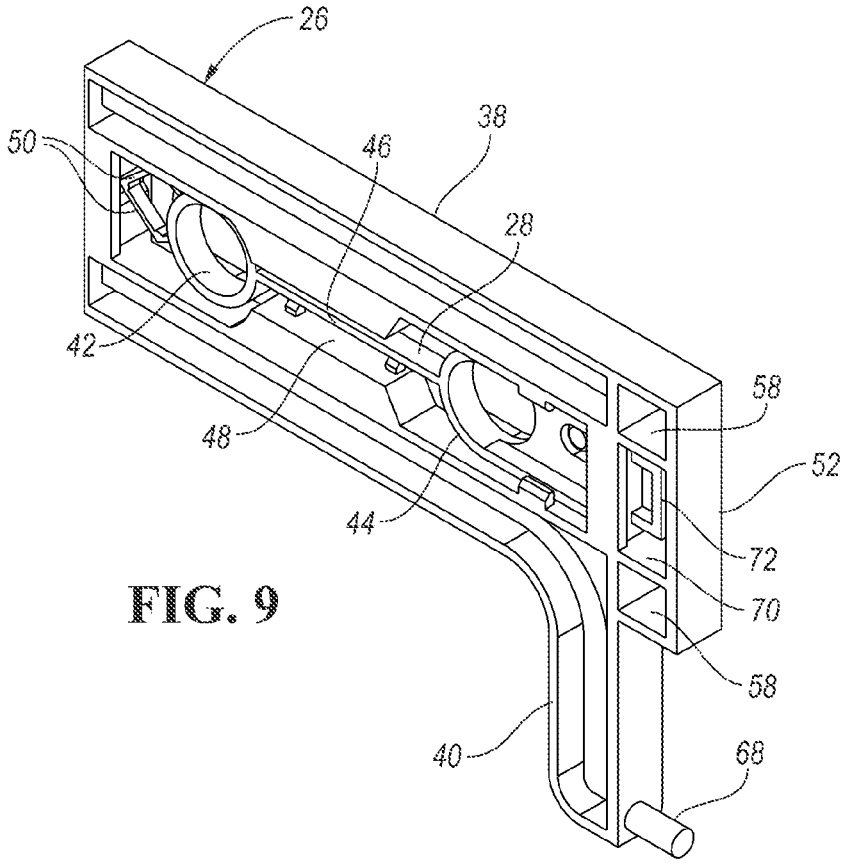
FIG. 9 is an interior perspective view of half of the door of the crate of FIG. 1.
Figure 10:
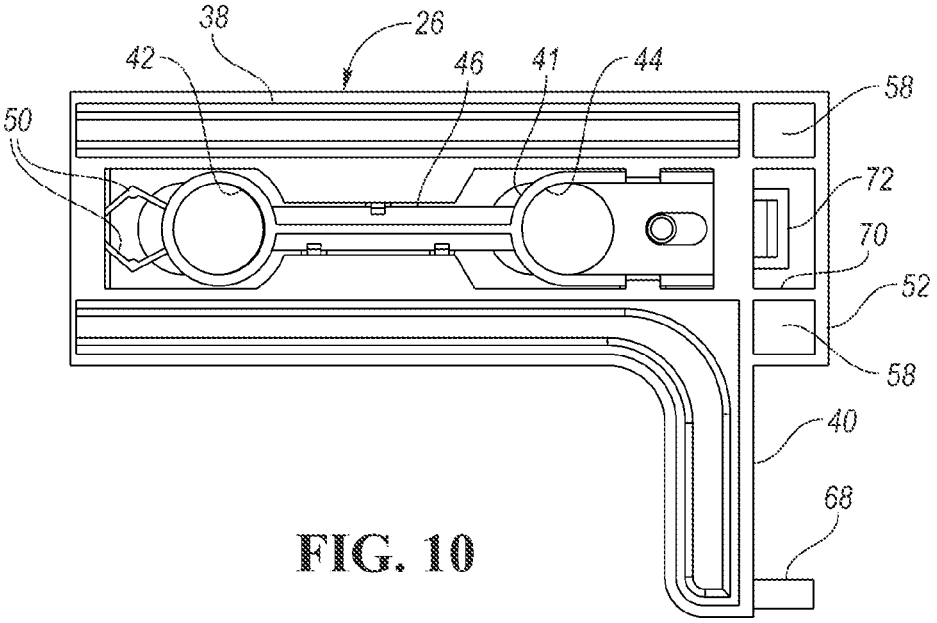
FIG. 10 is an interior view of the half of the door of FIG. 9.

FIG. 9 is an interior perspective view of half the door 26. The other half of the door 26 would be symmetrical. The inner handle portion 42 is connected to the outer handle portion 44 by the connecting rod 46. The latch 28 is biased outward by resilient legs 50 integrally formed with the latch 28 against a vertical surface of the door 26. The latch 28 is captured in a channel 48 formed in the upper panel portion 38. The wing portion 52 includes the pair of recesses 58. A center recess 70 is formed between the recesses 58 and is also open toward the interior surface. An interlocking portion 72 of the latch 28 projects into the wing portion 52 and into the center recess 70. By moving either of the handle portions 42, 44 inward (away from the wing portion 52), the interlocking portion 72 of the latch 28 would be removed or substantially removed from the center recess 70, thereby releasing the latch. FIG. 10 is an interior view of the half of the door 26 of FIG. 9.

Figure 11:
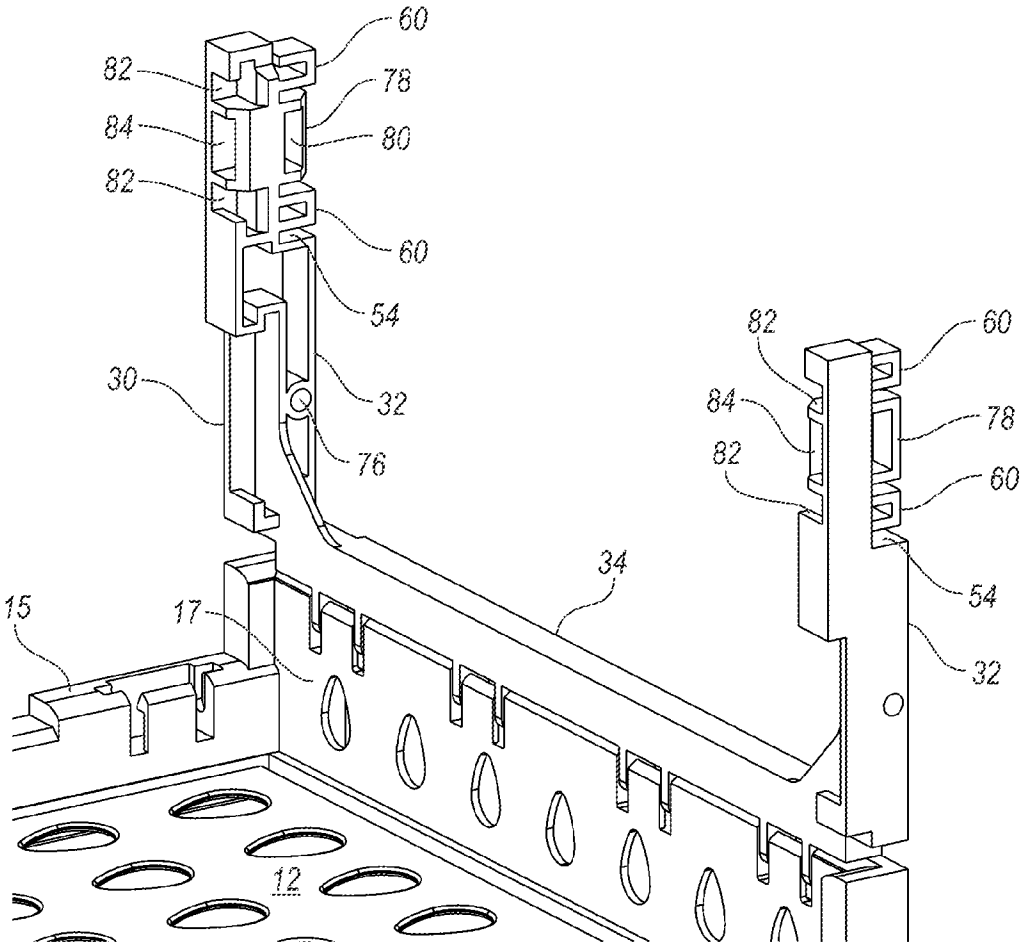
FIG. 11 is an interior view of the frame connected to the base of the crate of FIG. 1.

FIG. 11 is an interior view of the frame 30 connected to the base 12. Again, the frame 30 includes a pair of upstanding members 32 extending upward from and integrally molded with the cross bar 34. Each upstanding member includes a recess 54 at an upper portion thereof. A pair of interlocking projections 60 project forwardly into the recess 54. A center projection 68 also projects forwardly between the interlocking projections 60. The center projection 78 has a recess 80 opening laterally, toward the corresponding recess 80 (not visible) on the other upstanding member 32. Each upstanding member further includes a pair of interlocking recesses 82 opening rearwardly. Further, there is a center recess 84 opening rearwardly between the interlocking recesses 82. A hinge receiver 76 is formed in each upstanding member 32.

Figure 12:
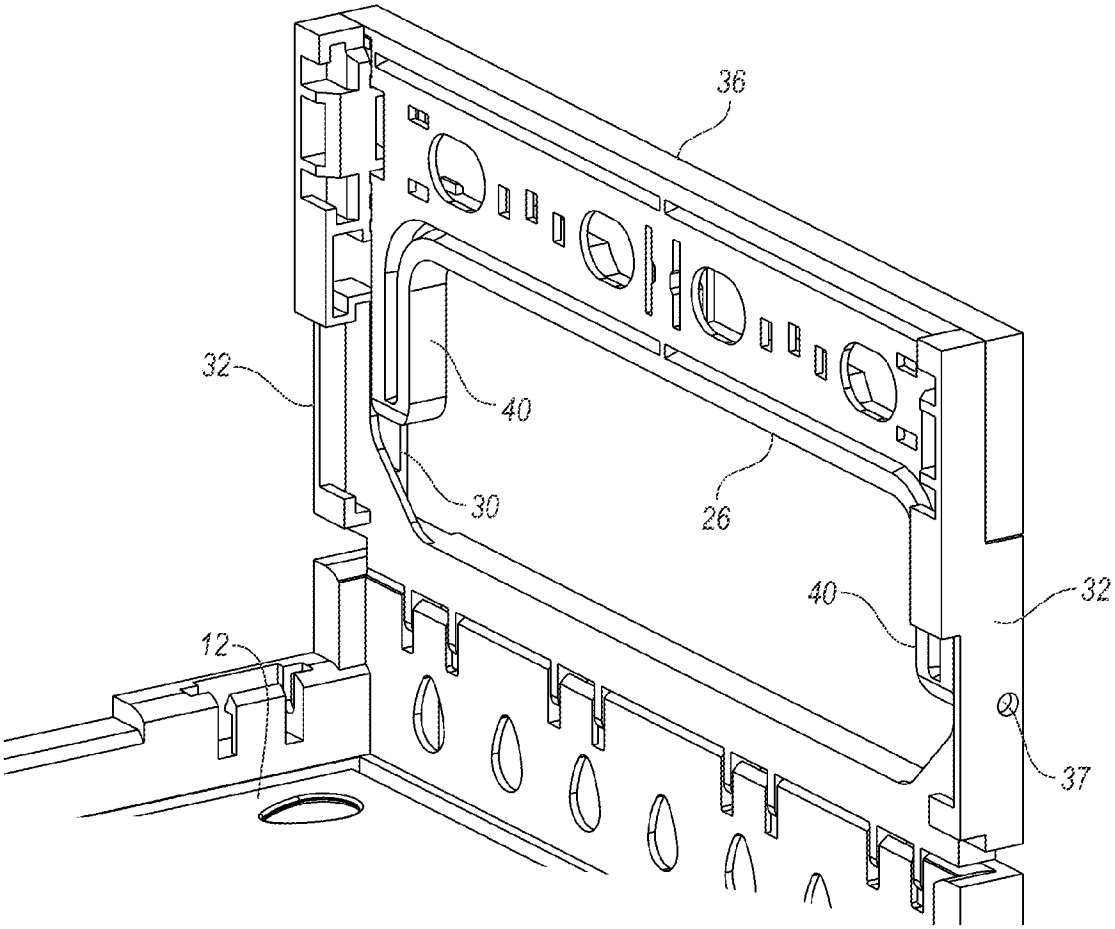
FIG. 12 shows the frame and base of FIG. 11 with door pivotably connected thereto.

FIG. 12 shows the frame 30 and base 12 of FIG. 11 with door 26 pivotably connected thereto. Although not visible, the projections 60 (FIG. 11) and center projections 78 are received in the corresponding recesses in the door 26. Further, when the door is latched, the projection 72 of each latch (FIG. 10) is received in the center recess 80 of each upstanding portion.

Figure 14:
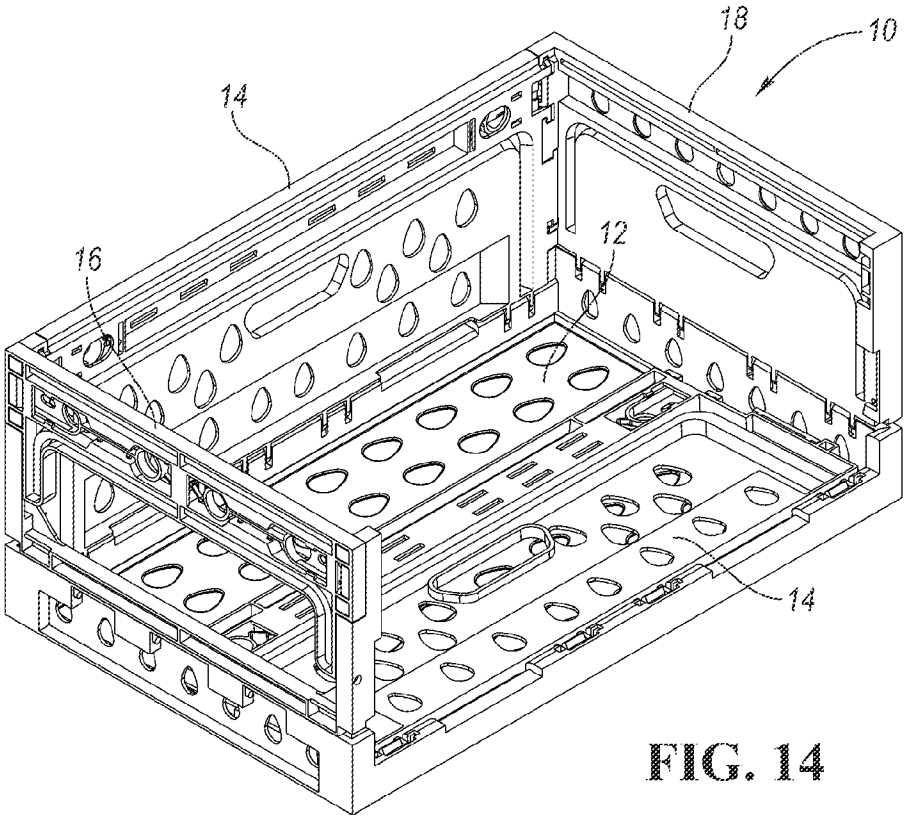
FIG. 14 shows the crate of FIG. 1 with one of the side walls pivoted downward onto the base.
Figure 13:
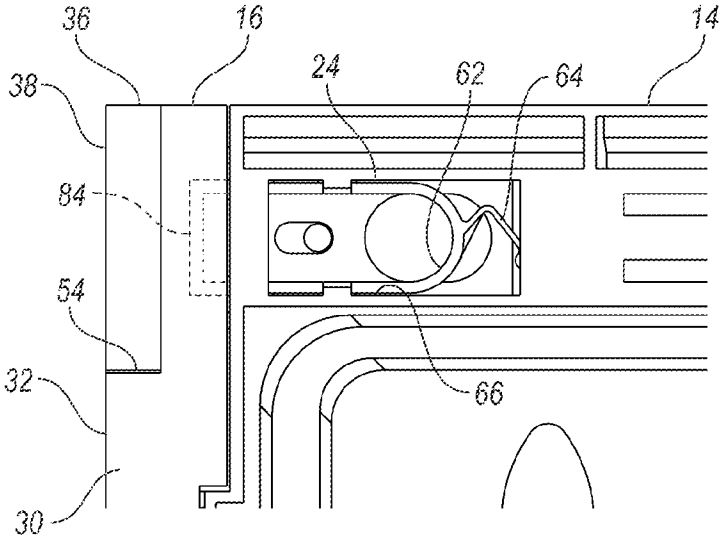
FIG. 13 is an exterior view of a portion of one end of the crate of FIG. 1.
Figure 15:
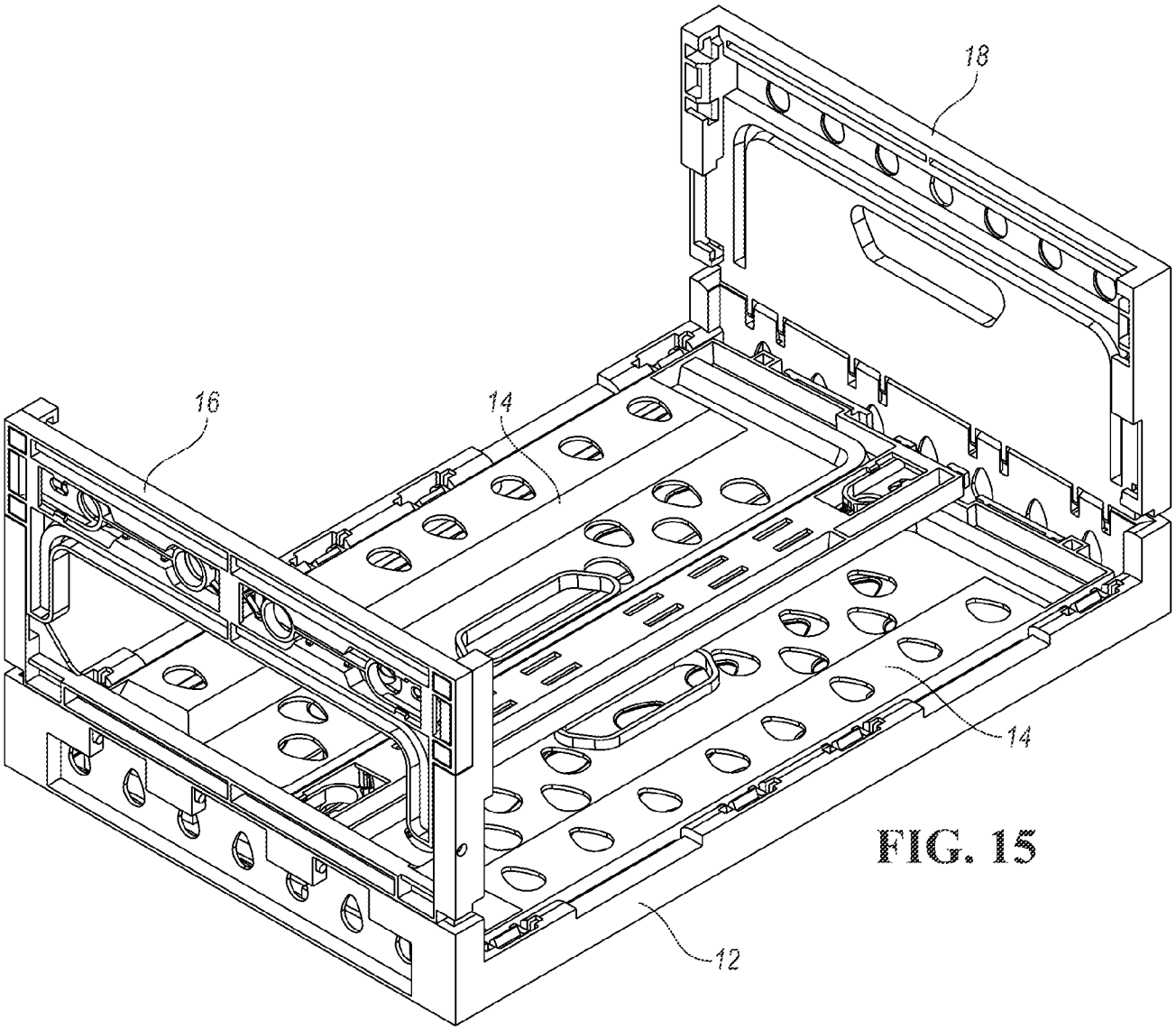
FIG. 15 shows the crate of FIG. 14 with the side walls pivoted downward onto the base.

Referring to FIG. 13, the sidewall 14 is latched to the frame 30 by a projecting portion of the latch 24 that extends into the center recess 84 of the frame 30. A similar recess is formed in the flanges 22 of the rear wall 18 (FIG. 1). The spring 64 biases the latch 24 toward the upstanding member 32 of the frame 30 into a latched engagement. The user can move the handle portion 62 and overcome the spring 64 to unlatch the side wall 14. The side wall 14 can then pivot downward onto the base 12 as shown in FIG. 14. The opposite side wall 14 can be unlatched and pivoted downward in the same manner onto the first side wall 14 as shown in FIG. 15.

Figure 16:
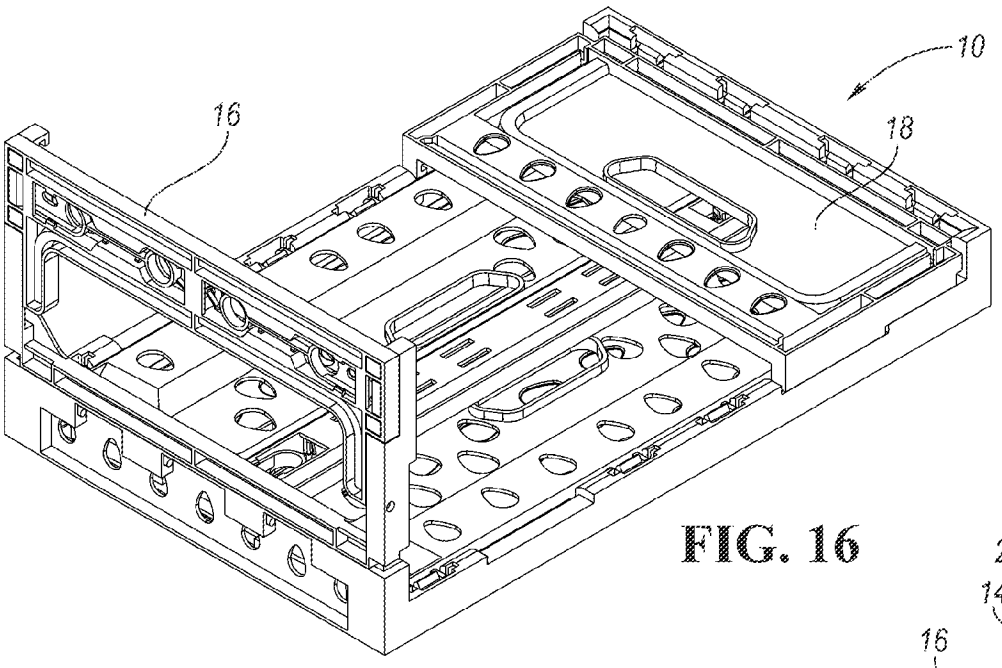
FIG. 16 shows the crate of FIG. 15 with an end wall pivoted downward onto the side walls.
Figure 17:
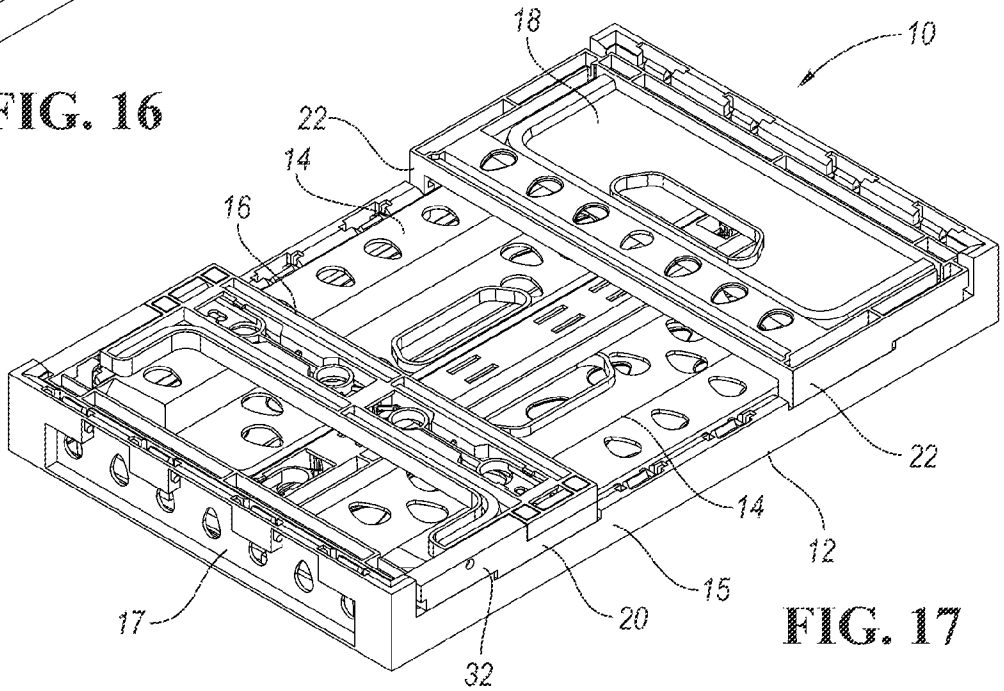
FIG. 17 shows the crate of FIG. 16 in the collapsed position.

The rear wall 18 and front wall 16 can be pivoted downward onto the side walls 14 and shown in FIGS. 16 and 17. The flanges 20 and 22 extend on either side of the side walls 14 and onto the side flanges 15.

Figure 19:
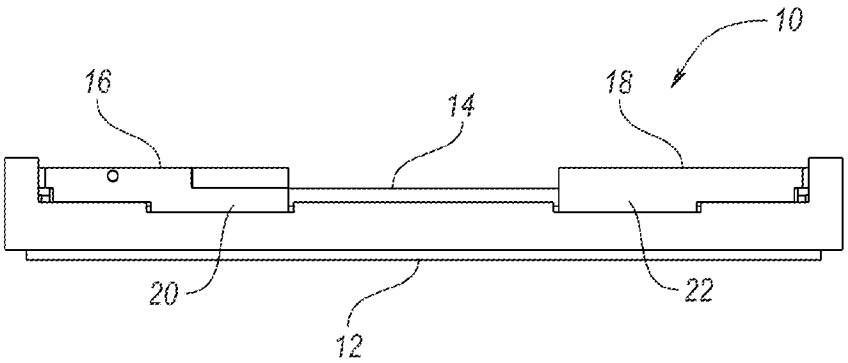
FIG. 19 is a side view of the crate of FIG. 17.
Figure 20:
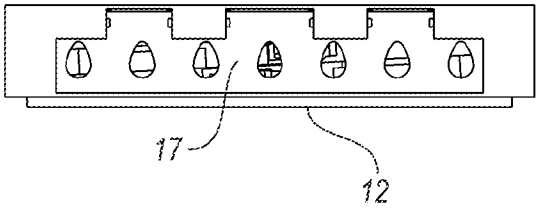
FIG. 20 is an end view of the crate of FIG. 19.
Figure 18:
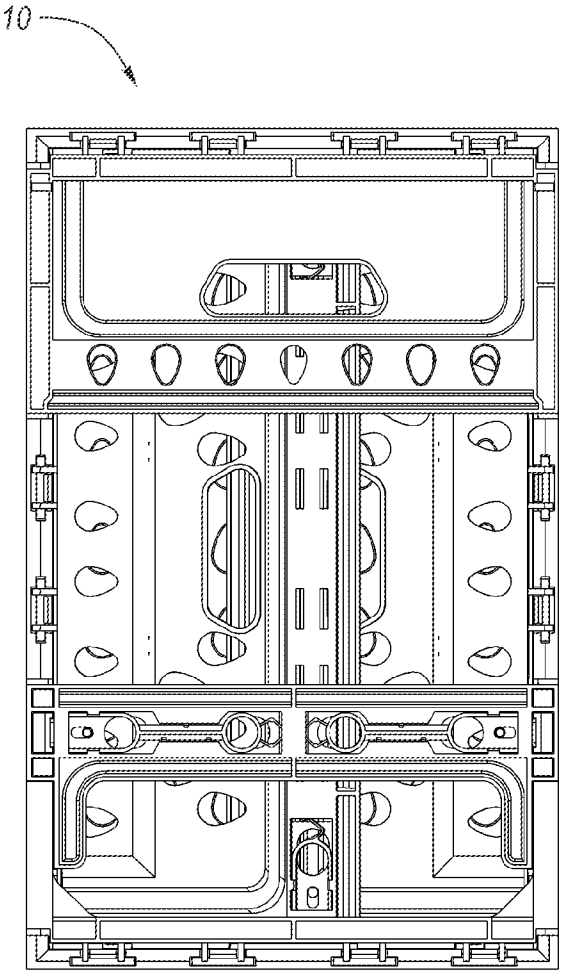
FIG. 18 is a top view of the crate of FIG. 17.

FIG. 18 is a top view of the crate 10 in a collapsed position. FIG. 19 is a side view of the collapsed crate 10. FIG. 20 is a front view of the collapsed crate 10.

Figure 21:
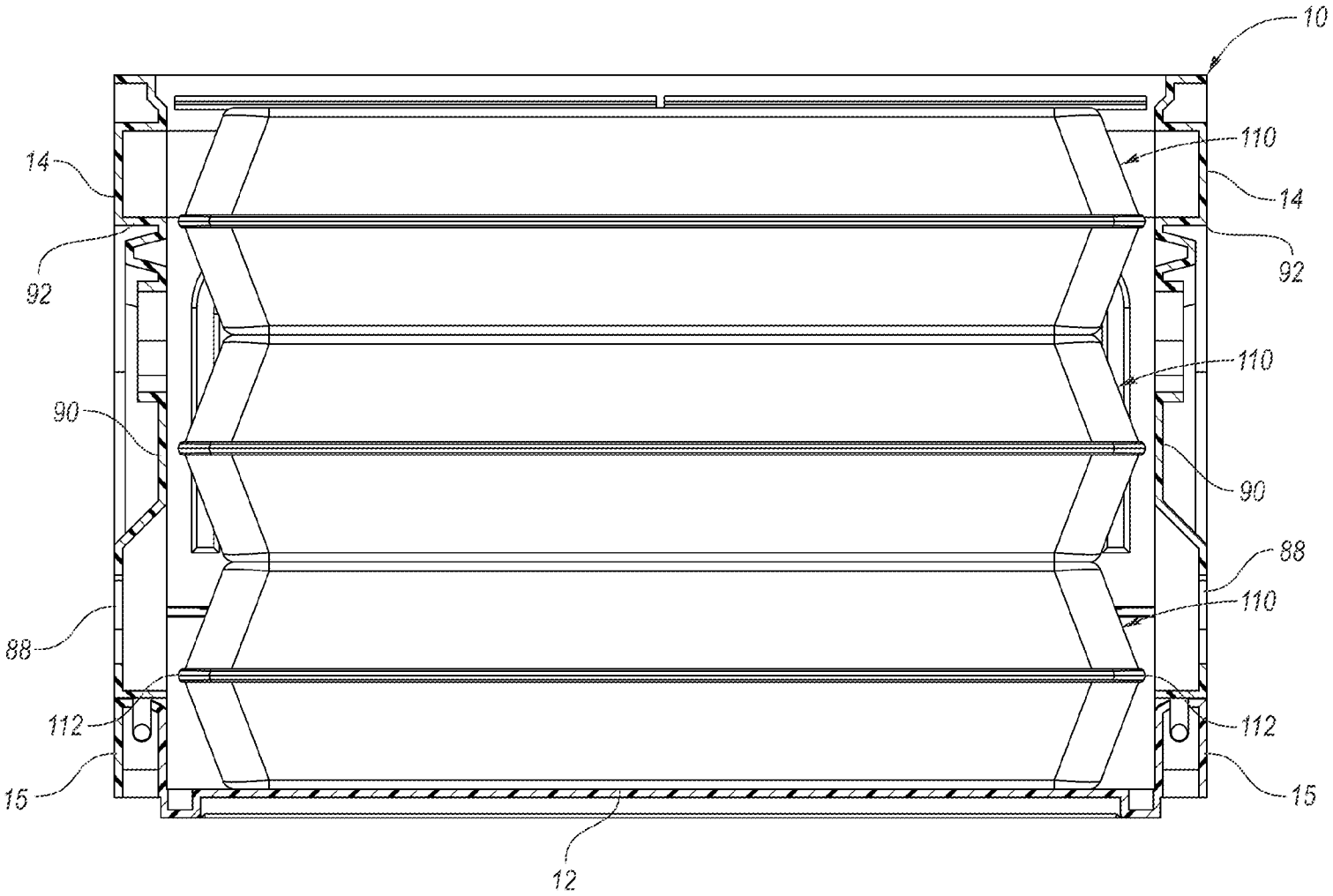
FIG. 21 is a section view of the crate of FIG. 1 with a plurality of containers loaded therein.

FIG. 21 is a section view of the crate 10 with a plurality of containers 110 loaded therein. In this example, the containers 110 are egg crates. The egg crates include an upper portion hingeably connected to a lower portion, and each tapered such that they meet at what is then the widest portion of the container 110, as shown. The section view of FIG. 21 illustrates the structure of the side walls 14 which are particularly adapted to facilitate the removal of egg cartons 110 through the front walls 16 (FIG. 1) of the crate 10.

Each side wall includes a lower portion 88 which is immediately adjacent and above the side flange 15, a mid-portion 90 above the lower portion 88, and an upper portion 92 above the mid-portion 90. The lower portion 88 includes a panel positioned outwardly of a center of the side wall 14 and outwardly of the pivot axis of the side wall 14, preferably at the outer footprint of the container 10 and substantially coplanar with an outer surface of the upstanding side flange 15. Moving upward, the wall 14 then transitions inward in the mid portion 90 of the side wall 14 where it is substantially coplanar with an inner surface of the upstanding side flange 15. Again moving upward, the side wall 14 then returns to the outer footprint of the crate 10 in the upper portion 92 of the side wall 14. The upper portion 92 of the side wall 14 contains the latches 24.

As shown, the widest portion 112 of the egg cartons 110 is aligned with the widest dimension of the side wall (i.e. with the lower portion 88) of the side wall above the upstanding side flange 15. This leaves more room for the user's fingers to grasp the egg carton.

Figure 22:
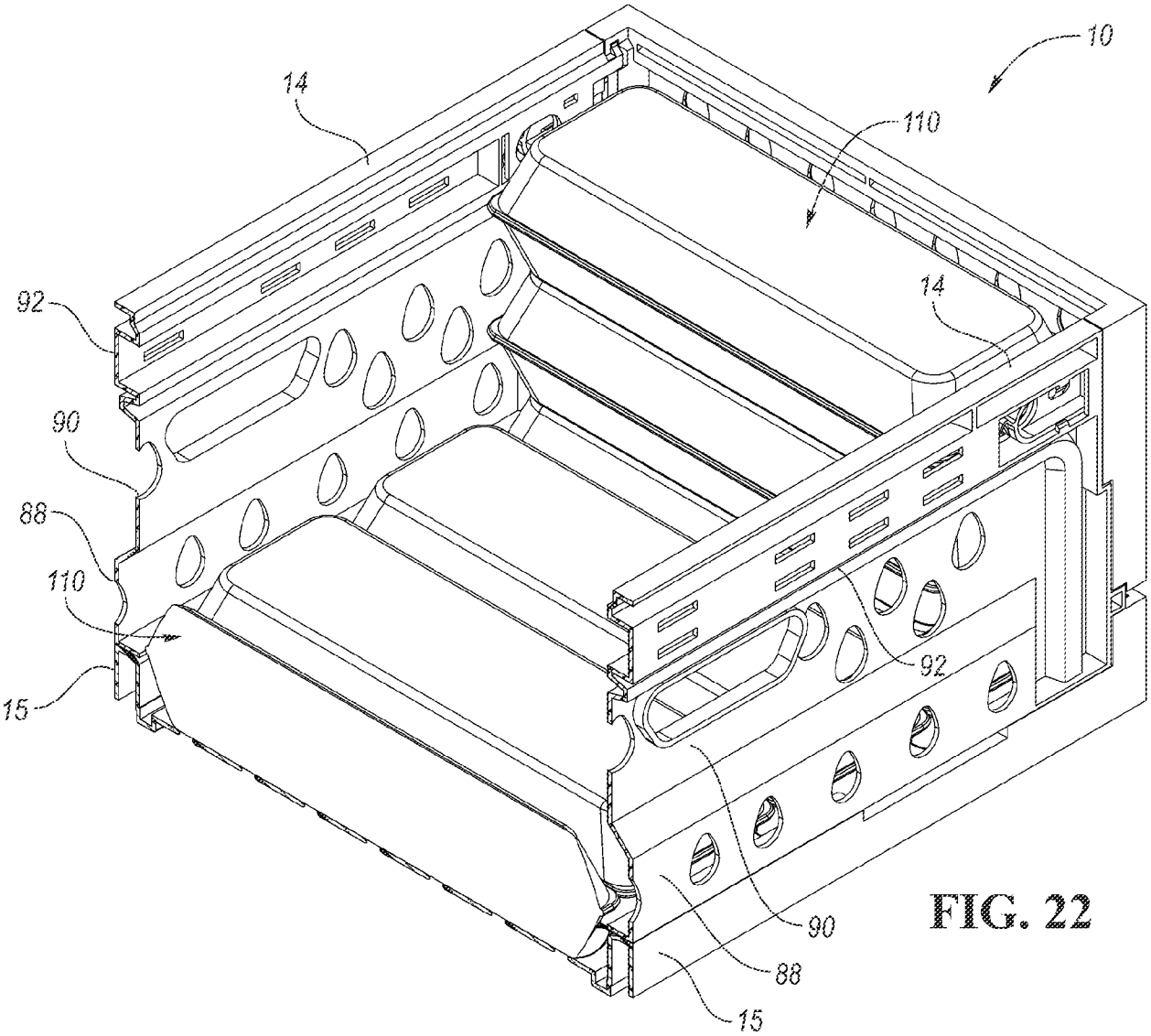
FIG. 22 is a perspective view of the crate of FIG. 1 containing a plurality of containers, partially broken away for illustration.

FIG. 22 is a perspective view of the crate 10 containing a plurality of egg cartons 110, partially broken away for illustration.

Figure 23:
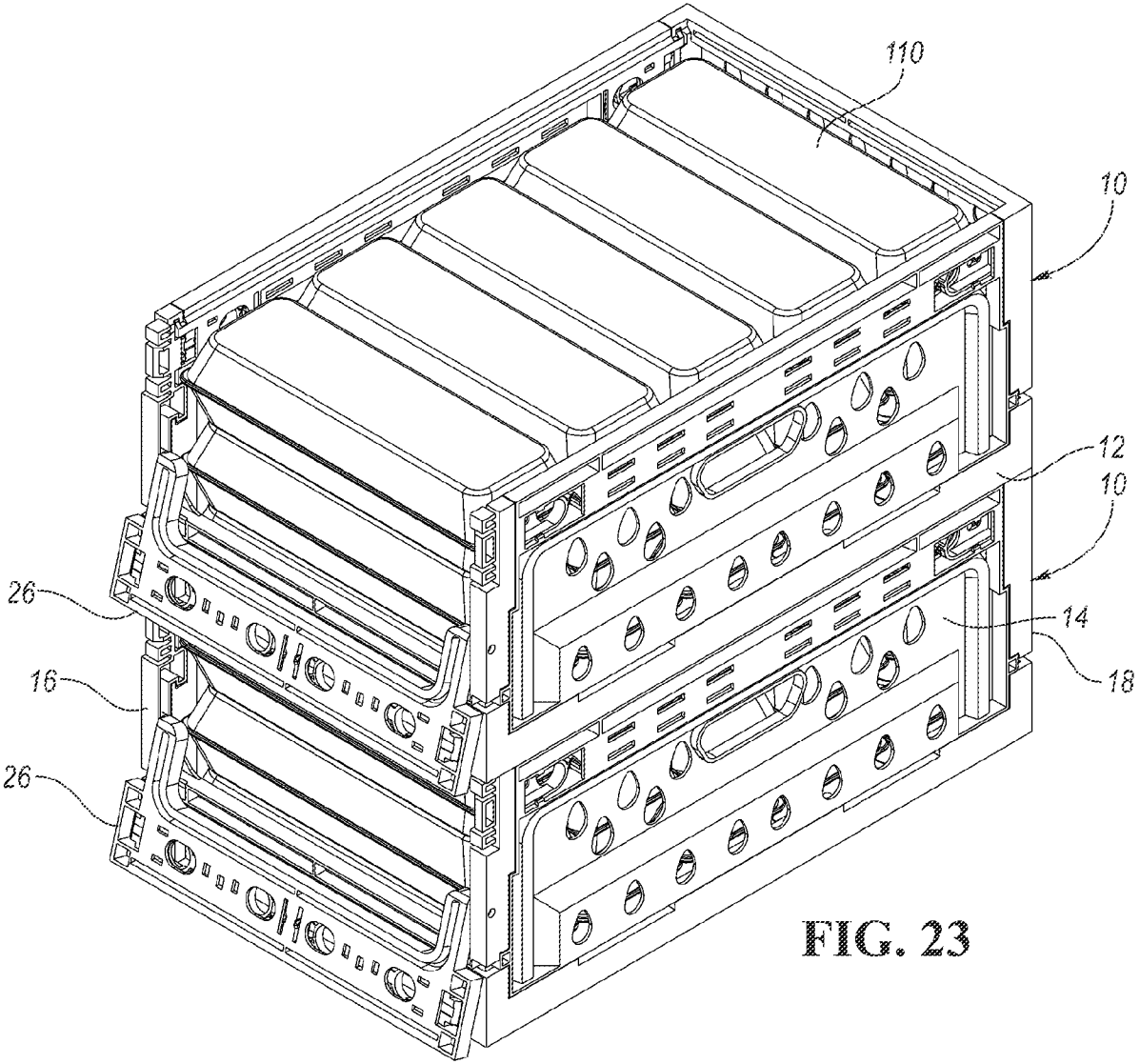
FIG. 23 shows a pair of crates 10 loaded with egg cartons 110 and stacked one upon the other.
Figure 24:
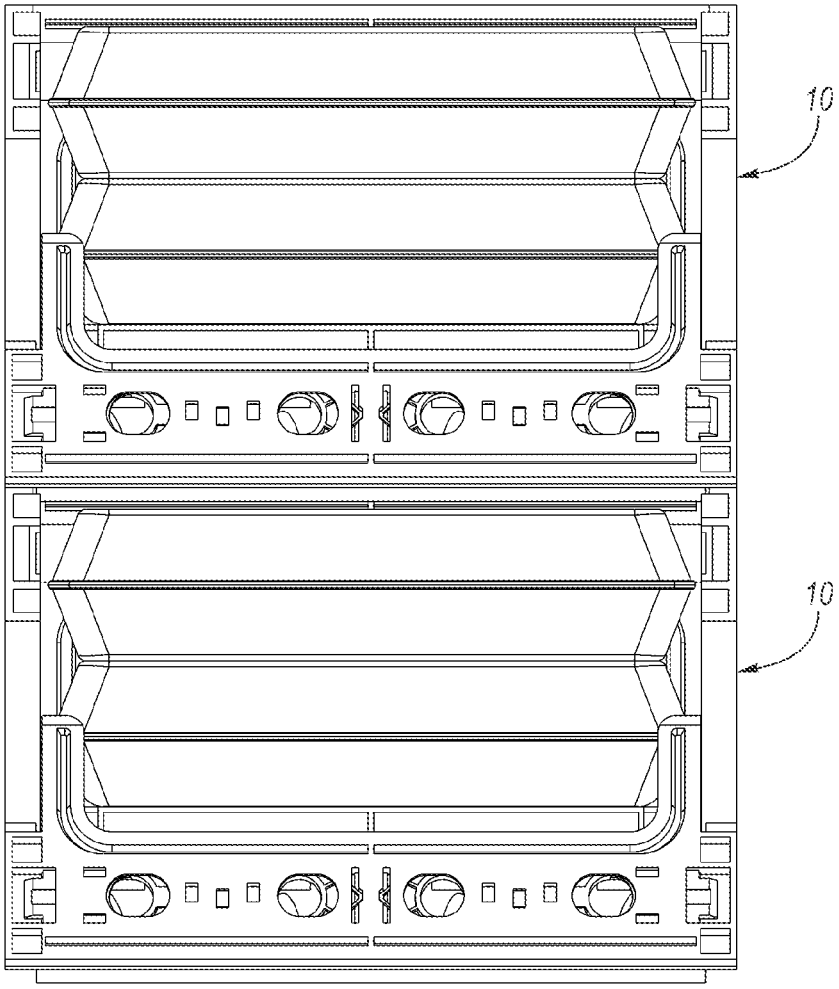
FIG. 24 is a front view of the crates 10 of FIG. 23.

FIG. 23 shows a pair of crates 10 loaded with egg cartons 110 and stacked one upon the other. As shown, the crates 10 can be loaded and stacked on one another while the front door 26 of each crate 10 is in the open, retracted position. FIG. 24 is a front view of the crates 10 of FIG. 23.

Figure 25:
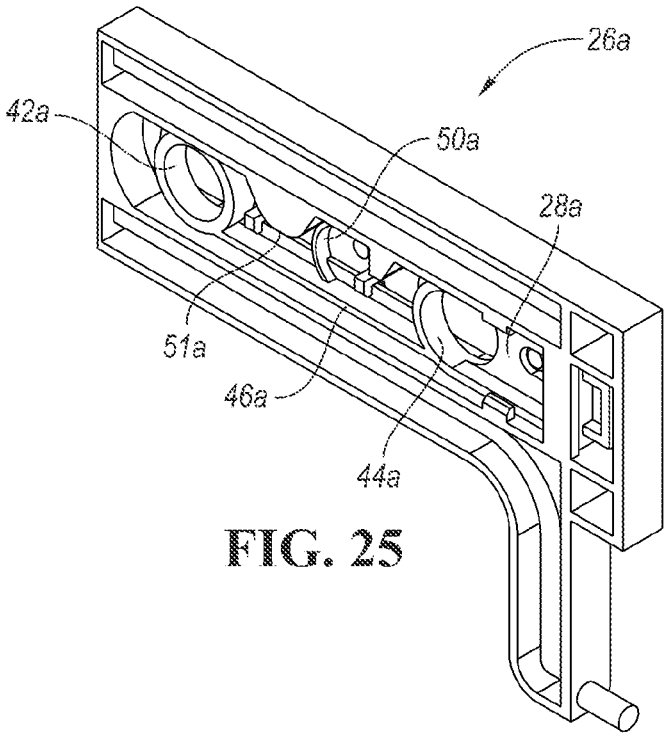
FIG. 25 shows half of an alternate door for the crate of FIG. 1.
Figure 26:
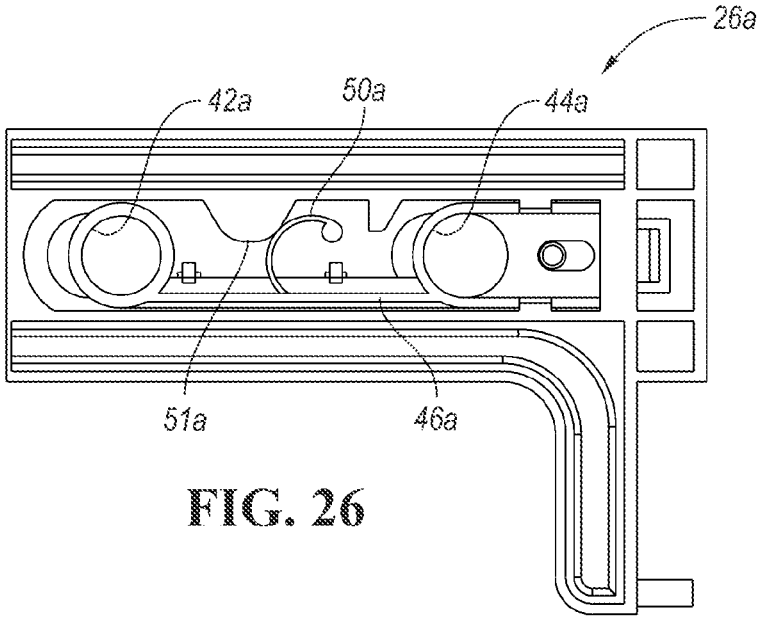
FIG. 26 is a front view of the door half of FIG. 25.

FIGS. 25 and 26 show an alternate configuration of a door 26*a* (the other half would be symmetric), with an alternate resilient leg 50*a* between the handle portions 42*a*, 44*a*. The resilient leg 50*a* is C-shaped and extends upward from the connecting rod 46*a*. The resilient leg 50*a* is formed integrally with the connecting rod 46*a*. The outer surface of the C-shaped resilient leg 50*a* contacts a concave surface 51*a* of the door 26*a* projecting downward inward of the resilient leg 50*a*, which biases the latch 28*a* toward the latched position. If the latch 28*a* is moved inward to the unlatched position, the resilient leg 50*a* resiliently flexes against the concave surface 51*a*, biasing the latch 28*a* back toward the latched position. The remainder of the door 26*a* and latch 28*a* is the same as the first embodiment.

Figure 27:
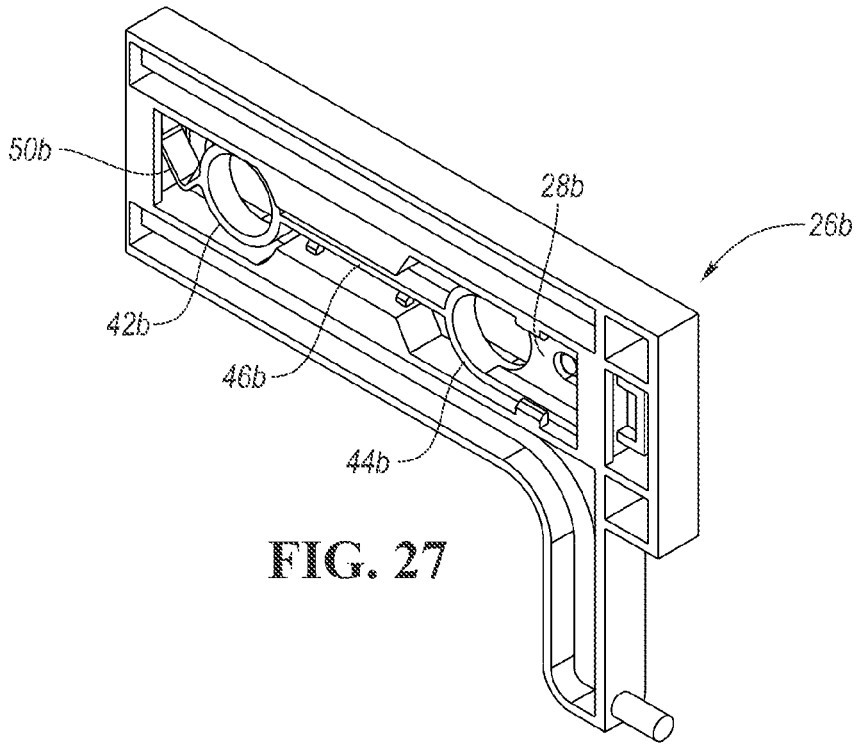
FIG. 27 shows half of another alternate door for the crate of FIG. 1.
Figure 28:
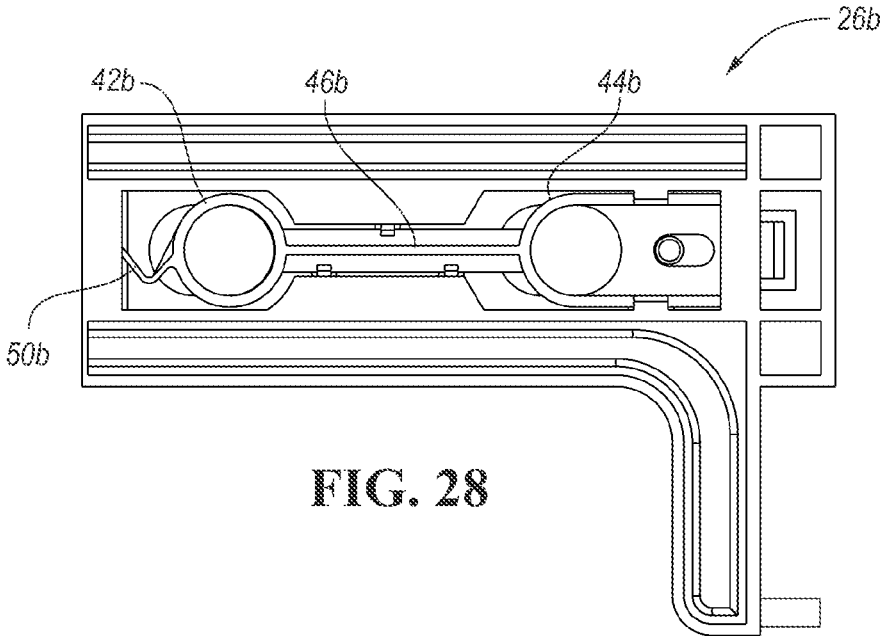
FIG. 28 is a front view of the door half of FIG. 27.

FIGS. 27 and 28 show another alternate configuration of a door 26*b* (the other half would be symmetric), with an alternate resilient leg 50*b* inward of the inner handle portion 42*b*. The resilient leg 50*b* is formed integrally with the inner handle portion 42*b*. The outer surface of the resilient leg 50*b* contacts a vertical surface of the door 26*b* inward of the inner handle portion 42*b*, which biases the latch 28*b* toward the latched position. The connected rod 46*b* integrally connects the inner handle portion 42*b* and the outer handle portion 44*b*. The remainder of the door 26*b* and latch 28*b* is the same as the first embodiment.

Figure 29:
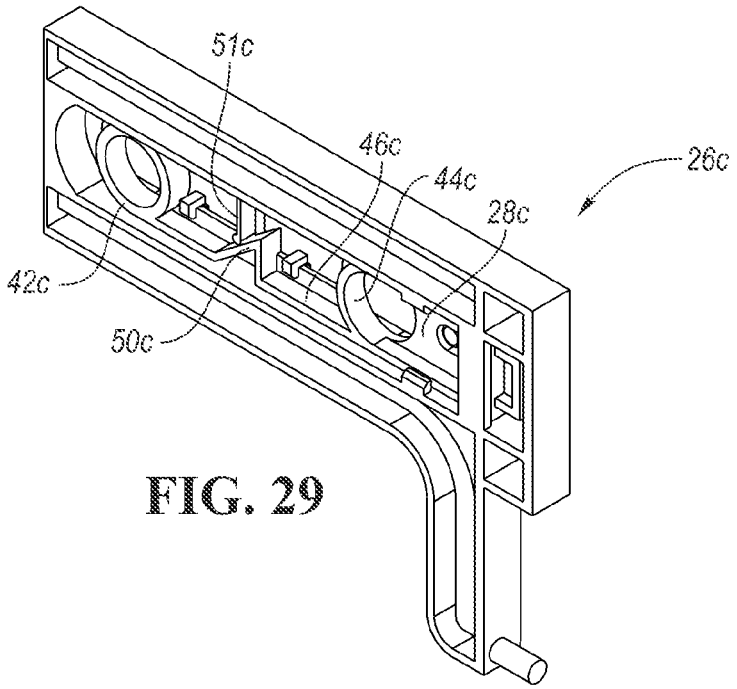
FIG. 29 shows half of another alternate door for the crate of FIG. 1.
Figure 30:
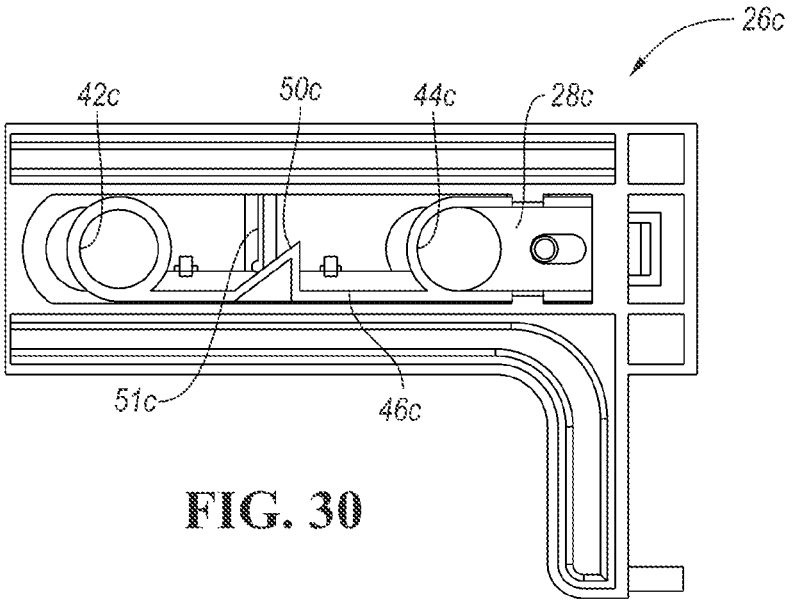
FIG. 30 is a front view of the door half of FIG. 29.

FIGS. 29 and 30 show yet another alternate configuration of the door 26*c* (the other half would be symmetric), with an integral ramped surface 50*c* between the handle portions 42*c*, 44*c* along the connected rod 46*c*. A resilient leg 51*c* is formed integrally with the door 26*c* and contacts the ramped surface 50*c* on the connecting rod 46*c*. When the latch 28*c* is moved inward, the resilient leg 51 is resiliently deformed against the ramped surface, which biases the latch 28*c* toward the latched position. The remainder of the door 26*c* and latch 28*c* is the same as the first embodiment.

Figure 31:
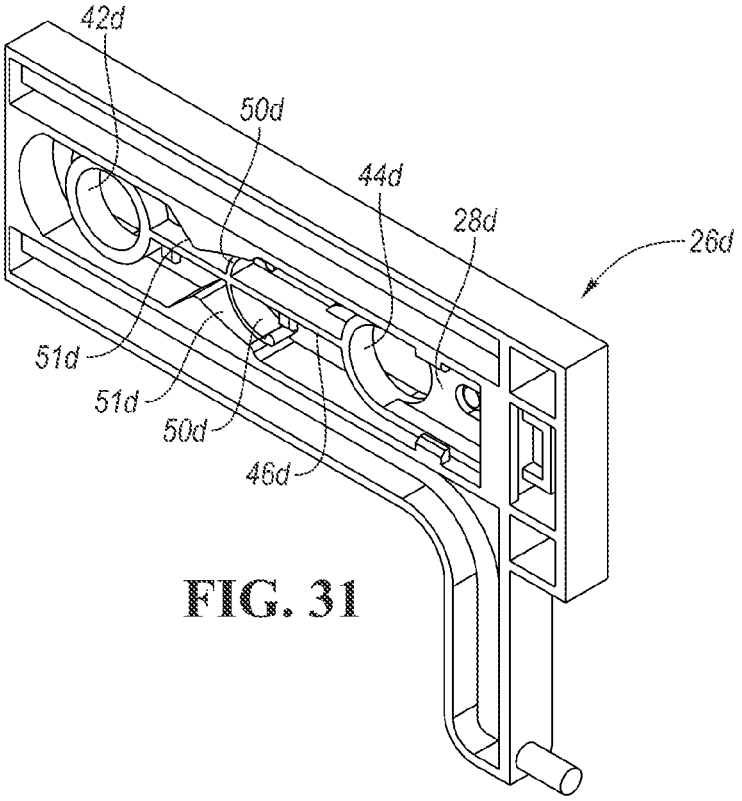
FIG. 31 shows half of another alternate door for the crate of FIG. 1.
Figure 32:
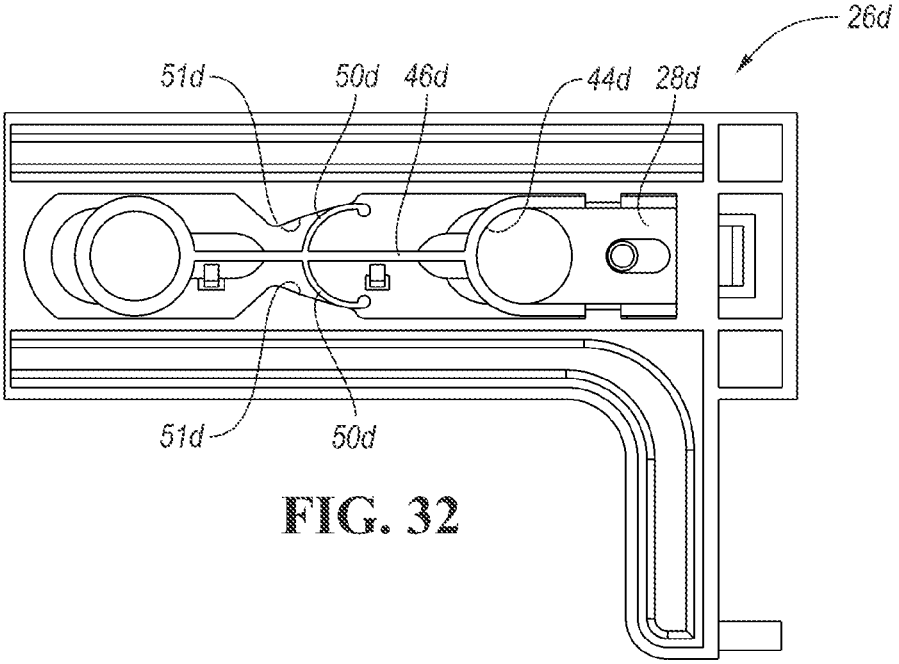
FIG. 32 is a front view of the door half of FIG. 31.

FIGS. 31 and 32 show yet another alternate door 26*d* (the other half would be symmetric), with alternate resilient legs 50*d* between the handle portions 42*d*, 44*d*. The resilient legs 50*d* are each arcuate, extending upward and outward from the connected rod 46*d* (one above and one below), and are formed integrally with the connected rod 46*d*. The outer surface of each resilient leg 50*d* contacts a ramped surface 51*d* of the door 26*d* projecting downward between the handle portions 42*d*, 44*d*, which biases the latch 28*d* toward the latched position. The remainder of the door 26*d* and latch 28*d* is the same as the first embodiment.

Figure 33:
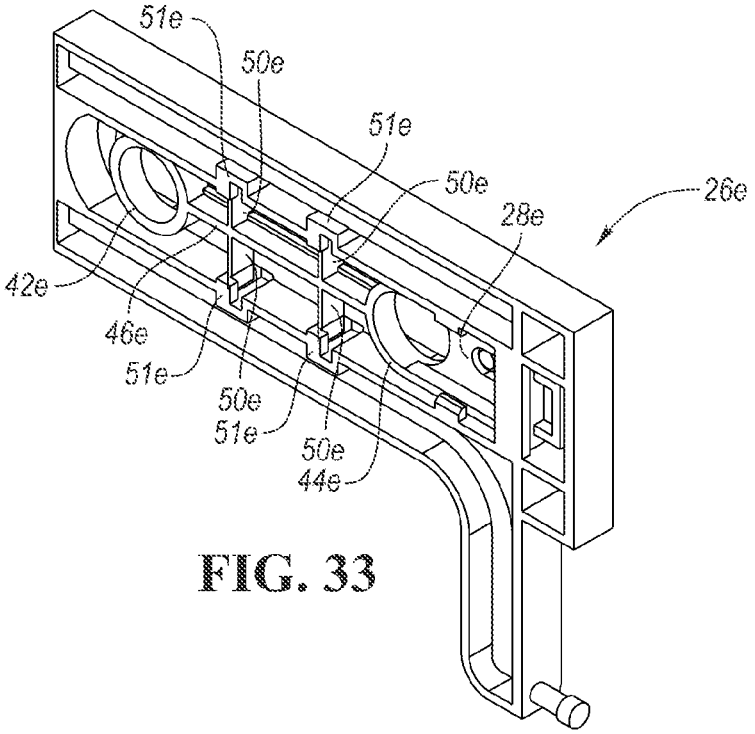
FIG. 33 shows half of another alternate door for the crate of FIG. 1.
Figure 34:
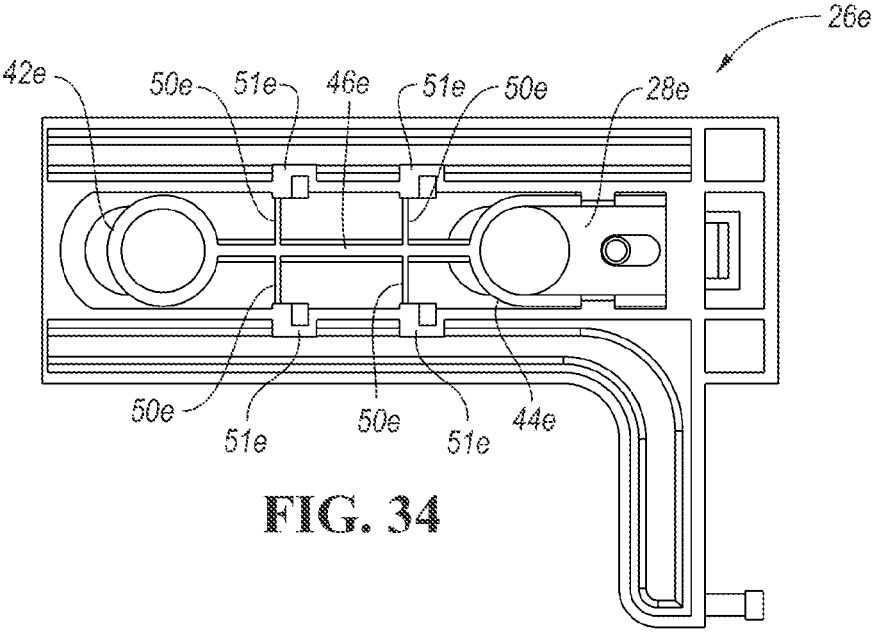
FIG. 34 is a front view of the door half of FIG. 33.

FIGS. 33 and 34 show an alternate configuration of a door 26*e* (the other half would be symmetric), with a plurality of resilient legs 50*e* between the handle portions 42*e*, 44*e*. The resilient legs 50*e* extend vertically (half upward, half downward) and are formed integrally with the connected rod 46*e*. In this embodiment, two resilient legs 50*e* extend upward and two extend downward, but fewer (e.g. one up, one down) or more (e.g. three up, three down) could be used. When the latch 28*e* is moved inward (unlatched), the inboard surface of each resilient leg 50*e* contacts a surface 51*e* of the door 26*e* between the handle portions 42*e*, 44*e*, which bias the latch 28*e* back toward the latched position. The remainder of the door 26*e* and latch 28*e* is the same as the first embodiment.

Figure 35:
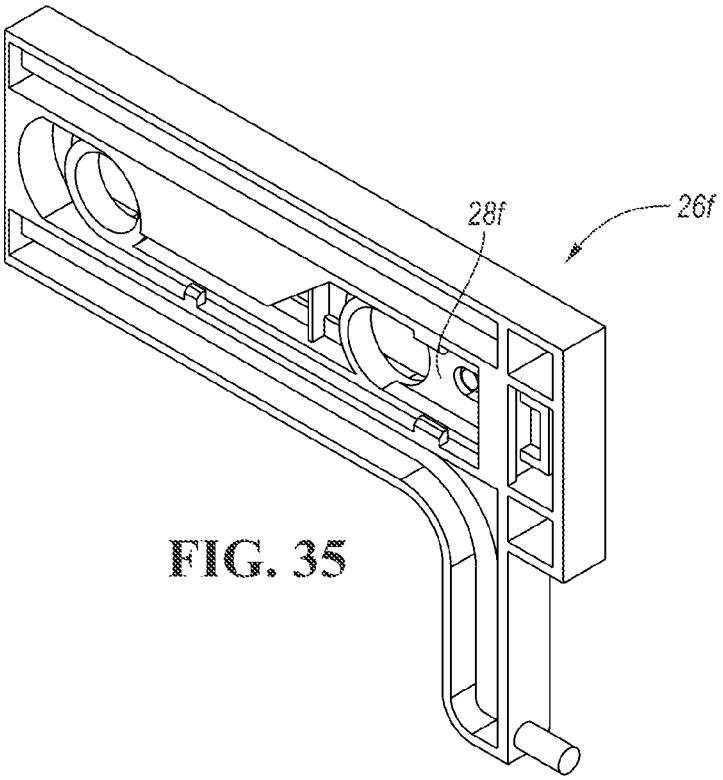
FIG. 35 shows half of another alternate door for the crate of FIG. 1.
Figure 36:
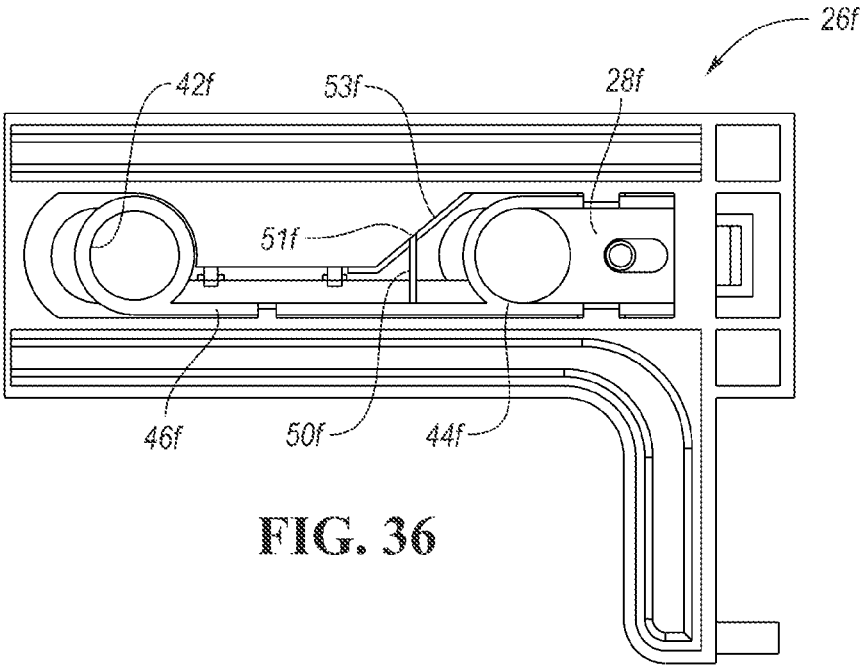
FIG. 36 is a front view of the door half of FIG. 35.

FIGS. 35 and 36 show an alternate configuration of a door 26*f* (the other half would be symmetric), with an alternate resilient leg 50*f* between the handle portions 42*f*, 44*f*. The resilient leg 50*f* extends vertically upward and is formed integrally with the connecting rod 46*f*. A resilient ramped surface 53*f* extends across the upper end of the resilient leg 50*f* at an acute angle. The ramped surface 53*f* contacts a complementary surface 51*f* of the door 26*f*. When the latch 28*f* is moved inward (unlatched), the resilient ramped surface 53*f* and resilient leg 50*f* are resiliently deformed, which biases the latch 28*f* outward toward the latched position. The remainder of the door 26*f* and latch 28*f* is the same as the first embodiment.

Figure 37:
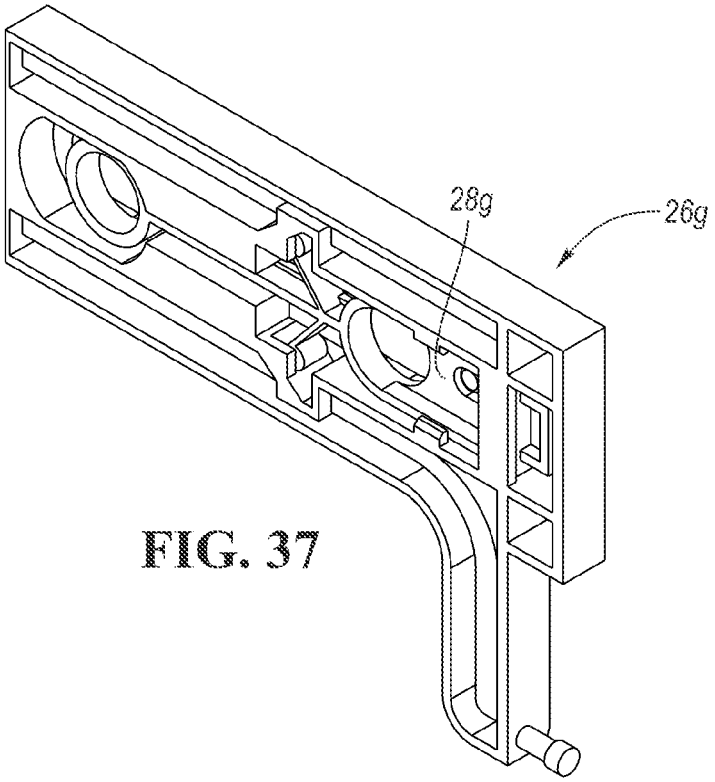
FIG. 37 shows half of another alternate door for the crate of FIG. 1.
Figure 38:
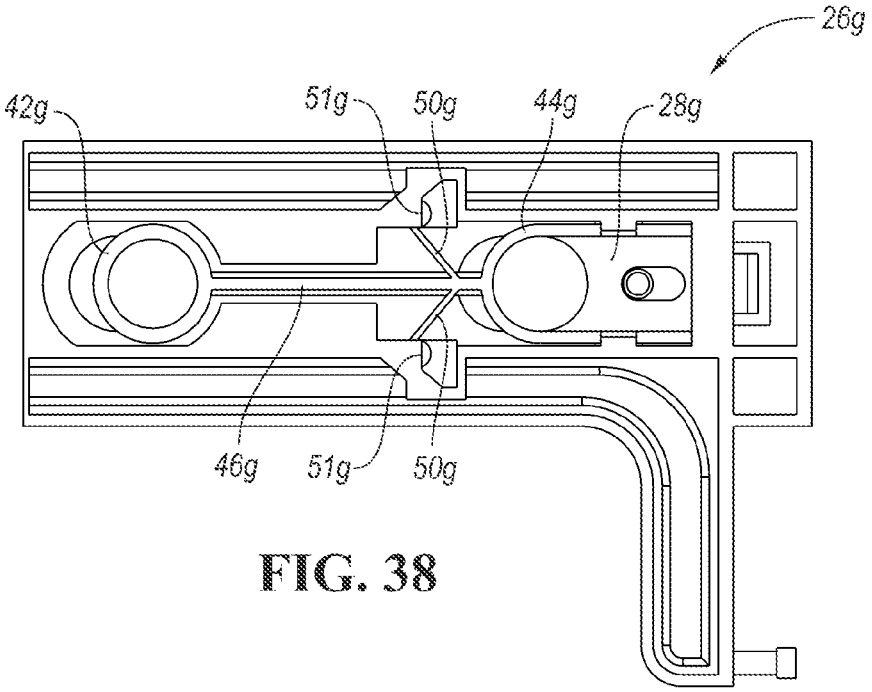
FIG. 38 is a front view of the door half of FIG. 37.

FIGS. 37 and 38 show an alternate configuration of a door 26*g* (the other half would be symmetric), with a pair of resilient legs 50*g* between the handle portions 42*g*, 44*g*. The resilient legs 50*g* extend inward at an angle (one upward, one downward) and are formed integrally with the connected rod 46*g*. The inboard end of each resilient leg 50*g* contacts a surface 51*g* in a pocket in the door 26*g* between the handle portions 42*g*, 44*g*, which bias the latch 28*g* toward the latched position. The pockets accommodate the ends of the resilient legs 50*g* as they move upward when the latch 28*g* is moved inward (unlatched), resiliently deforming the resilient legs 50*g* and causing the legs 50*g* to bias the latch 28*g* toward the latched position. The remainder of the door 26*g* and latch 28*g* is the same as the first embodiment.

Figure 39:
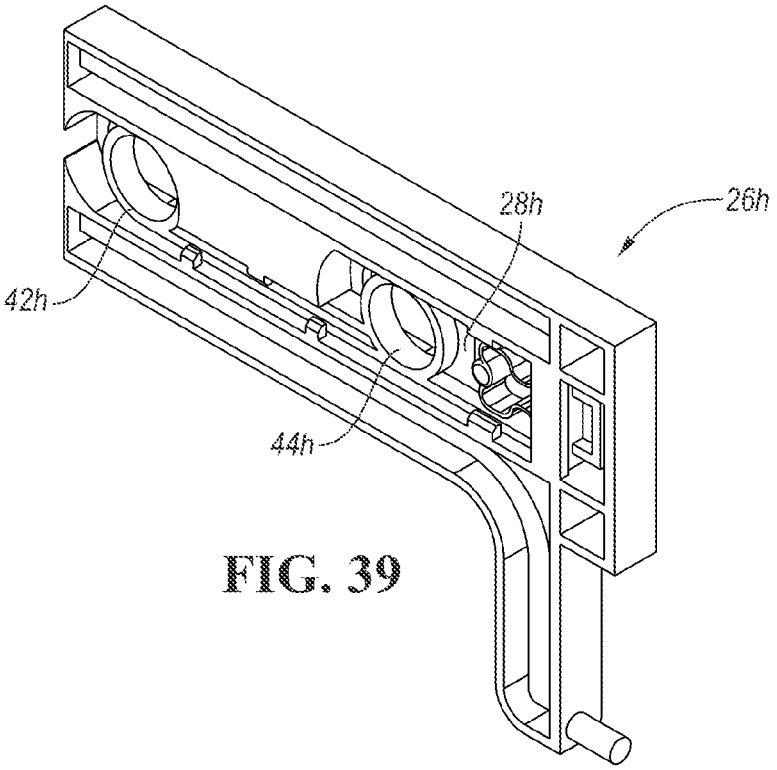
FIG. 39 shows half of another alternate door for the crate of FIG. 1.
Figure 40:
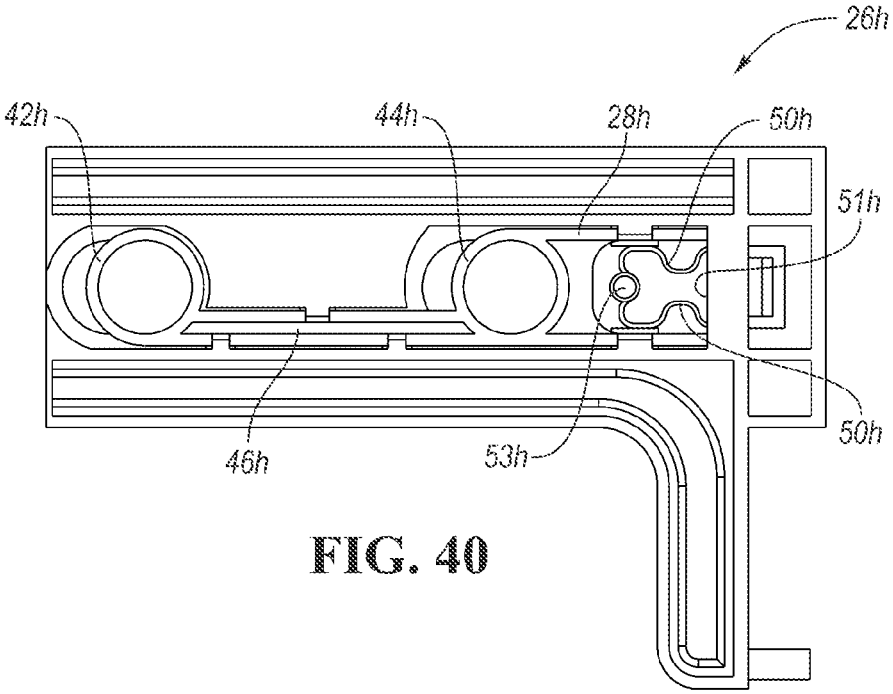
FIG. 40 is a front view of the door half of FIG. 39.

FIGS. 39 and 40 show an alternate configuration of a door 26*h* (the other half would be symmetric), with a pair of resilient legs 50*g* outward of the outer handle portion 44*h*. The resilient legs 50*h* are captured between a peg 53*h* integral with (or otherwise fixed to) the door 26*h* and a vertical surface 51*h* of the latch 28*h* outward of the outer handle portion 44*h*. The resilient legs 50*h* are resiliently deformed when the latch 28*h* is moved inward (unlatched), and then bias the latch 28*g* back toward the latched position. The inner handle portion 42*h* is connected by the connected rod 46*h* to the inner handle portion 44*h*. The remainder of the door 26*g* and latch 28*g* is the same as the first embodiment.

Figure 41:
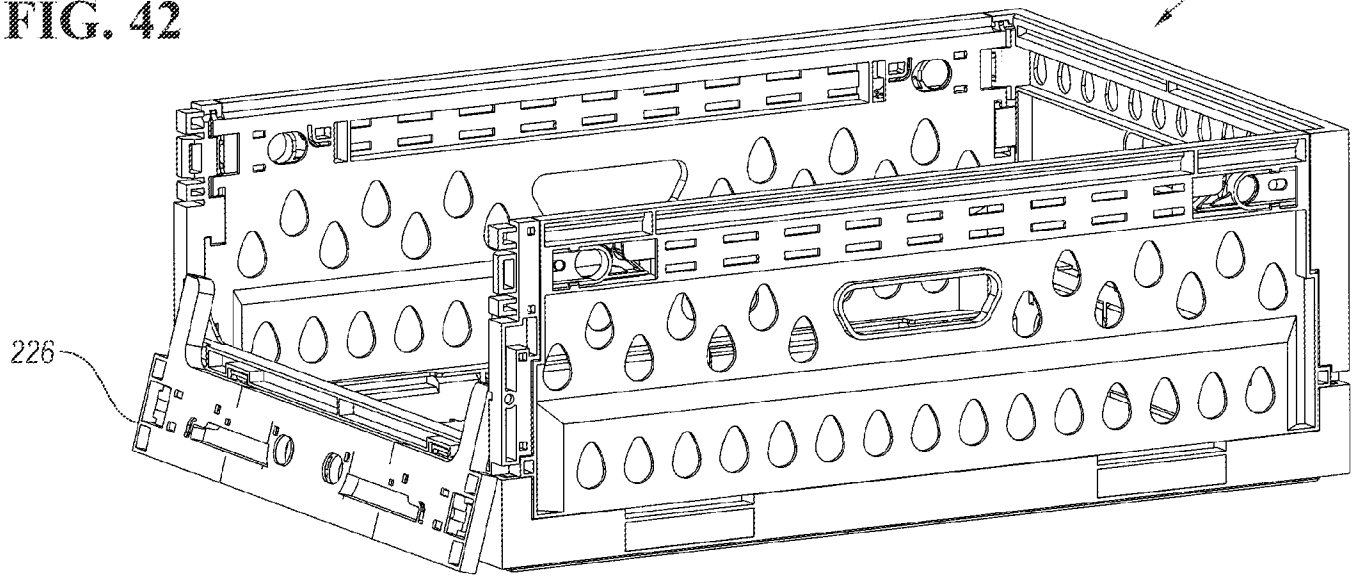
FIG. 41 is a perspective view of a collapsible container according to another embodiment, with the door open.

FIG. 41 is a perspective view of a collapsible container 210 according to another embodiment. The container 210 is substantially the same as the container 10 of FIG. 1 but larger, to accommodate twice as many egg cartons. In FIG. 41, the door 226 is shown in the open position.

Figure 42:
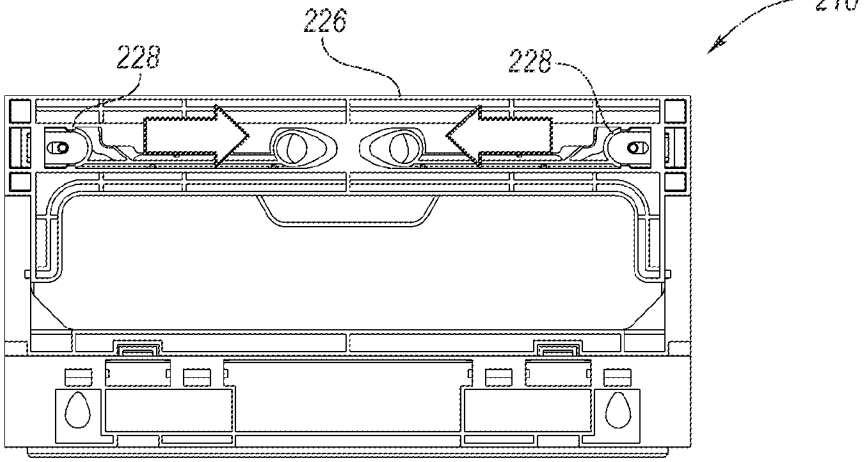
FIG. 42 is a front view of the container of FIG. 41 with the door closed.

FIG. 42 is a front view of the container 210 of FIG. 41 with the door 226 closed. As indicated, and as in the first embodiment, the latches 228 can be moved toward one another to release the door 226.

Figure 43:
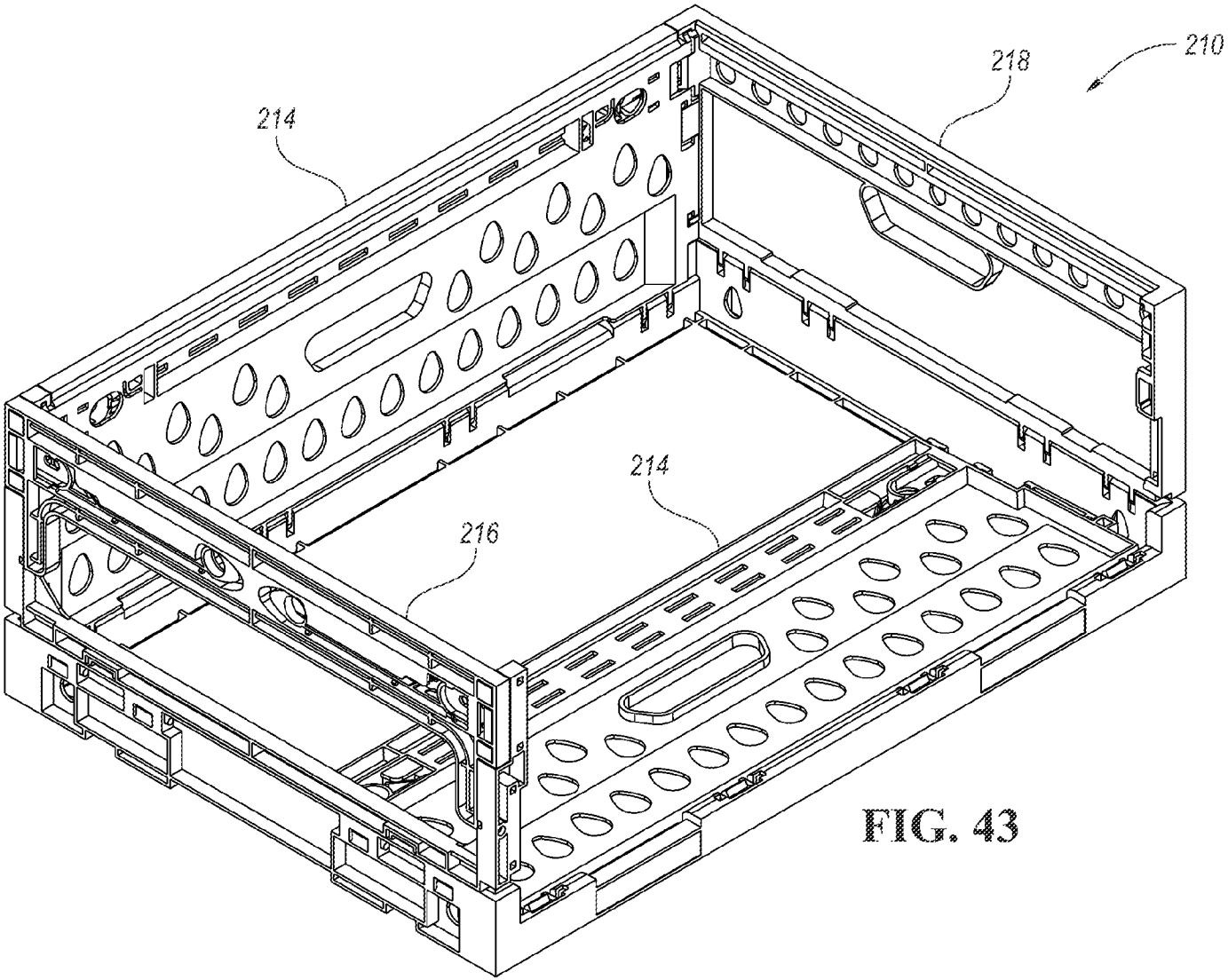
FIG. 43 is a perspective view of the container of FIG. 41 with the one of the side walls collapsed.
Figure 44:
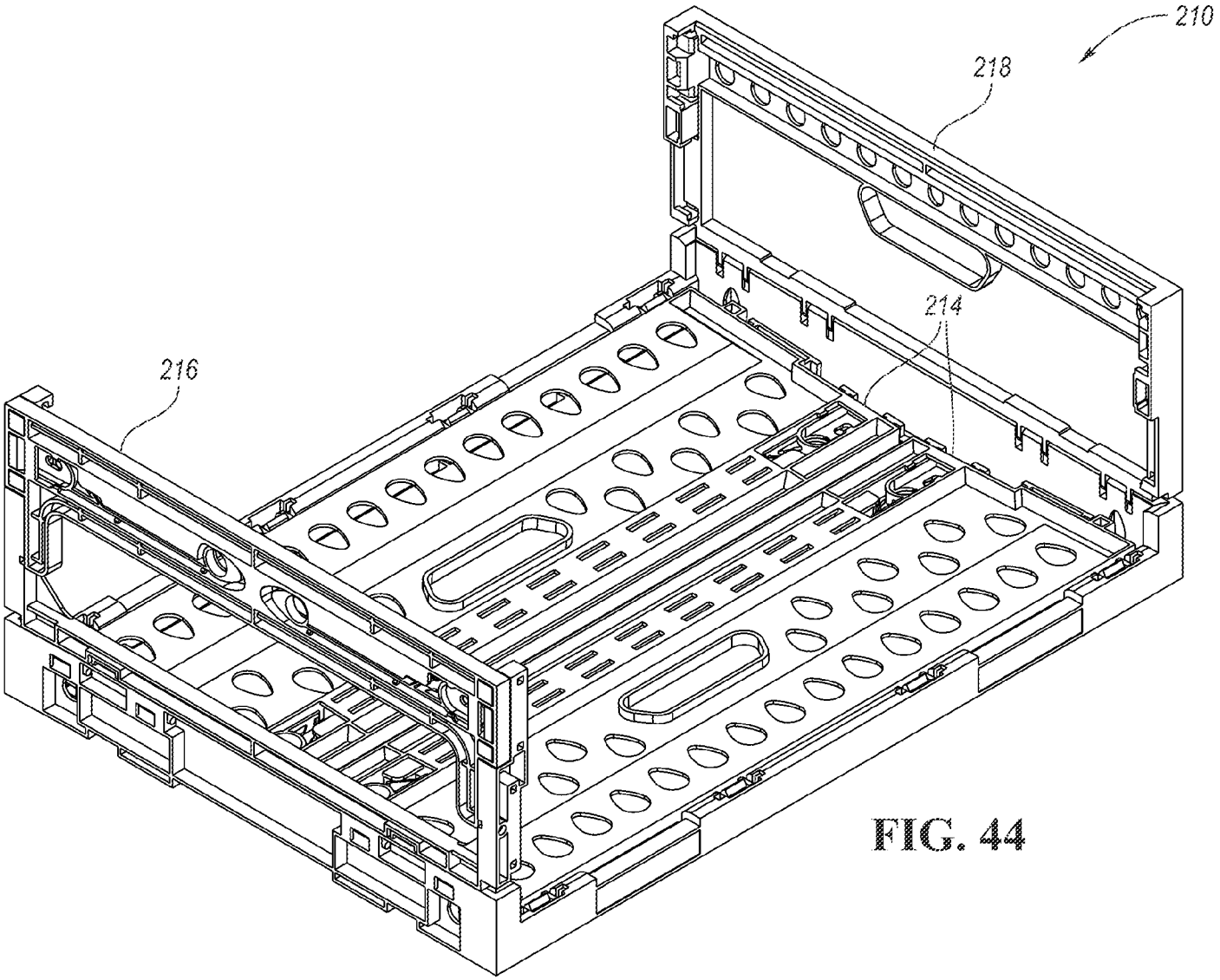
FIG. 44 shows the container of FIG. 43 with both side walls collapsed.
Figure 45:
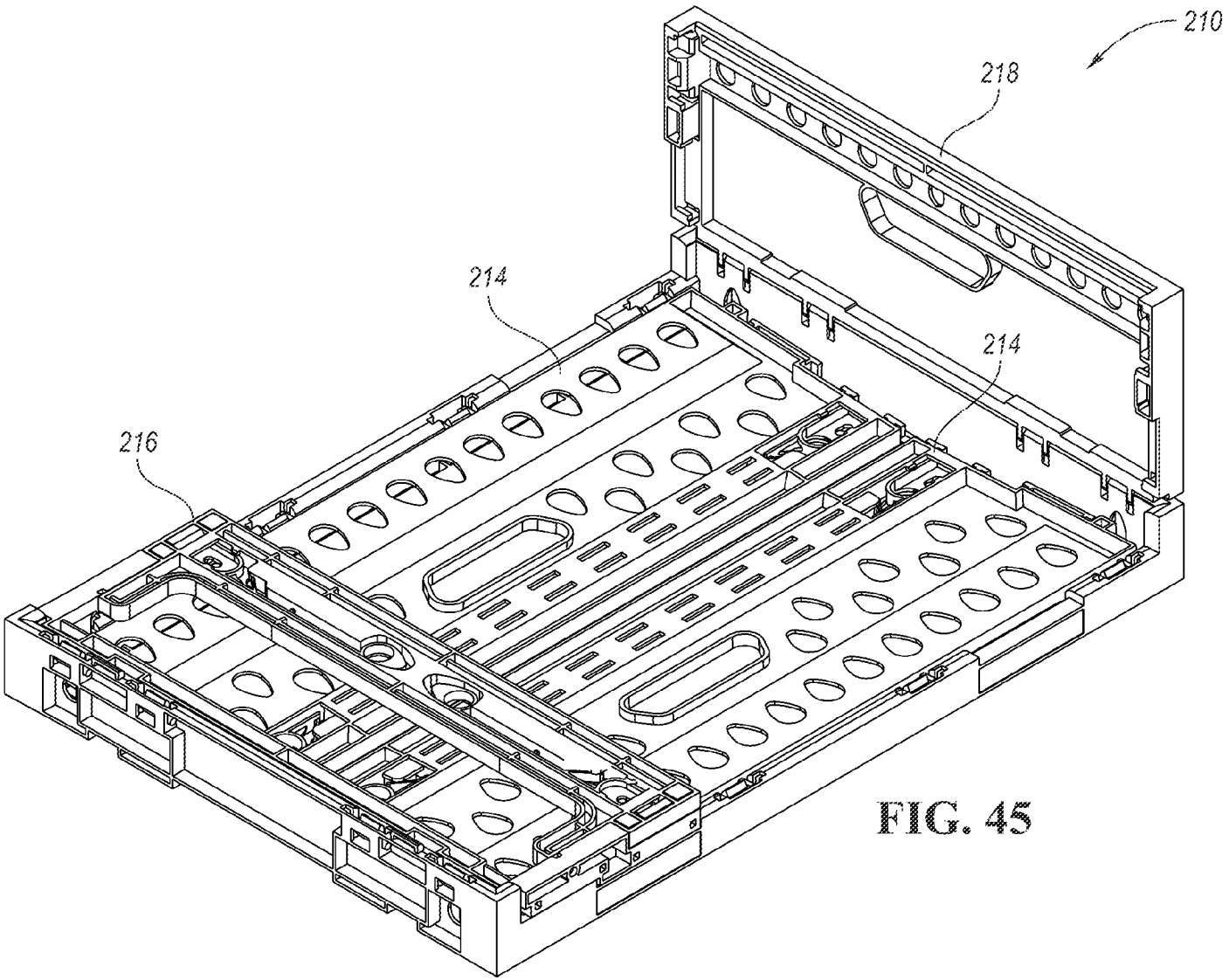
FIG. 45 shows the container of FIG. 44 with the front wall collapsed.
Figure 46:
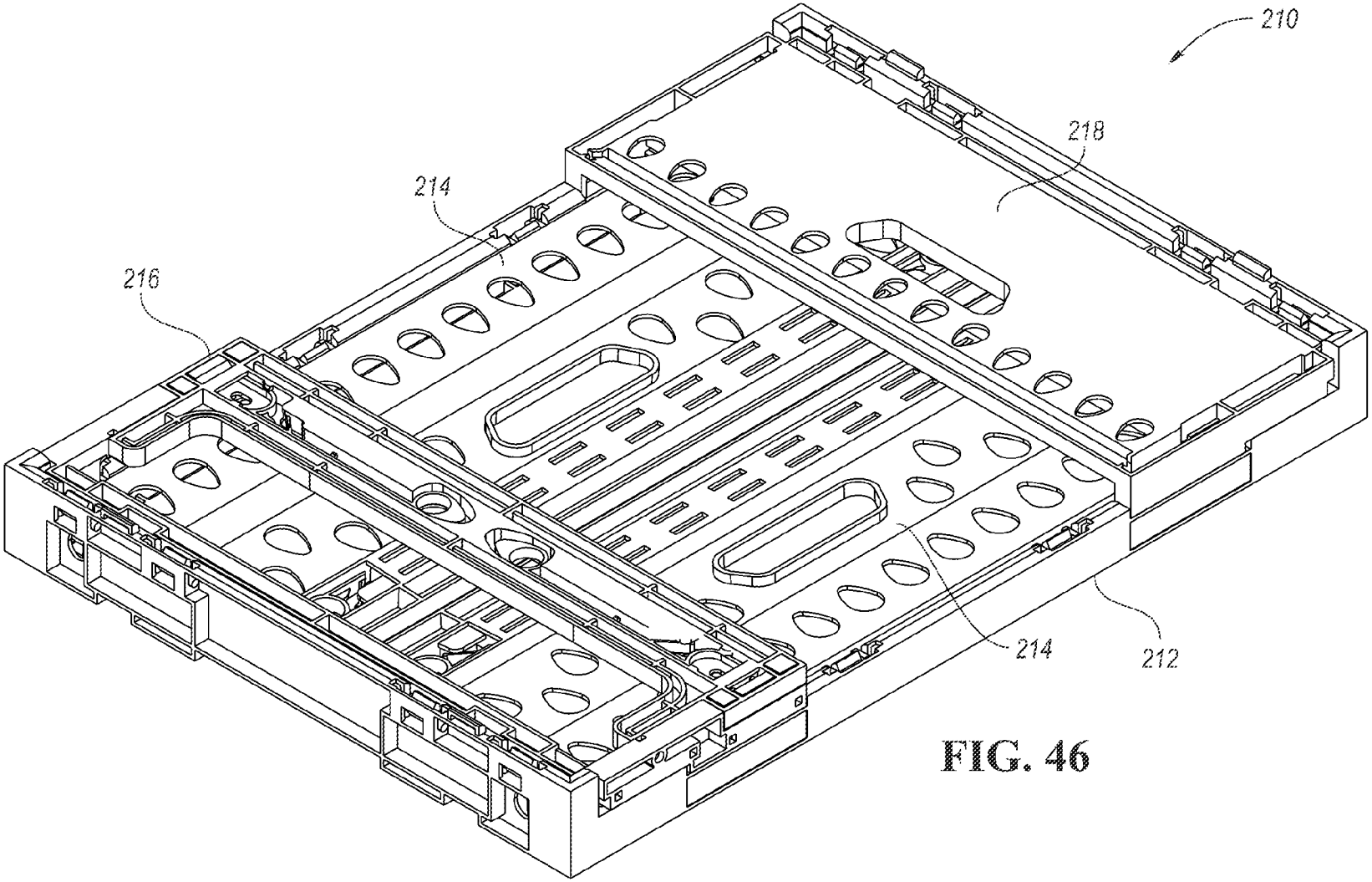
FIG. 46 shows the container of FIG. 45 with all of the walls collapsed.

FIG. 43 is a perspective view of the container 210 of FIG. 41 with one of the side walls 214 collapsed. FIG. 44 shows the container 210 of FIG. 43 with both side walls 214 collapsed. FIG. 45 shows the container 210 of FIG. 44 with the front wall 216 collapsed. FIG. 46 shows the container 210 with all of the walls collapsed onto the base 212.

Figure 47:
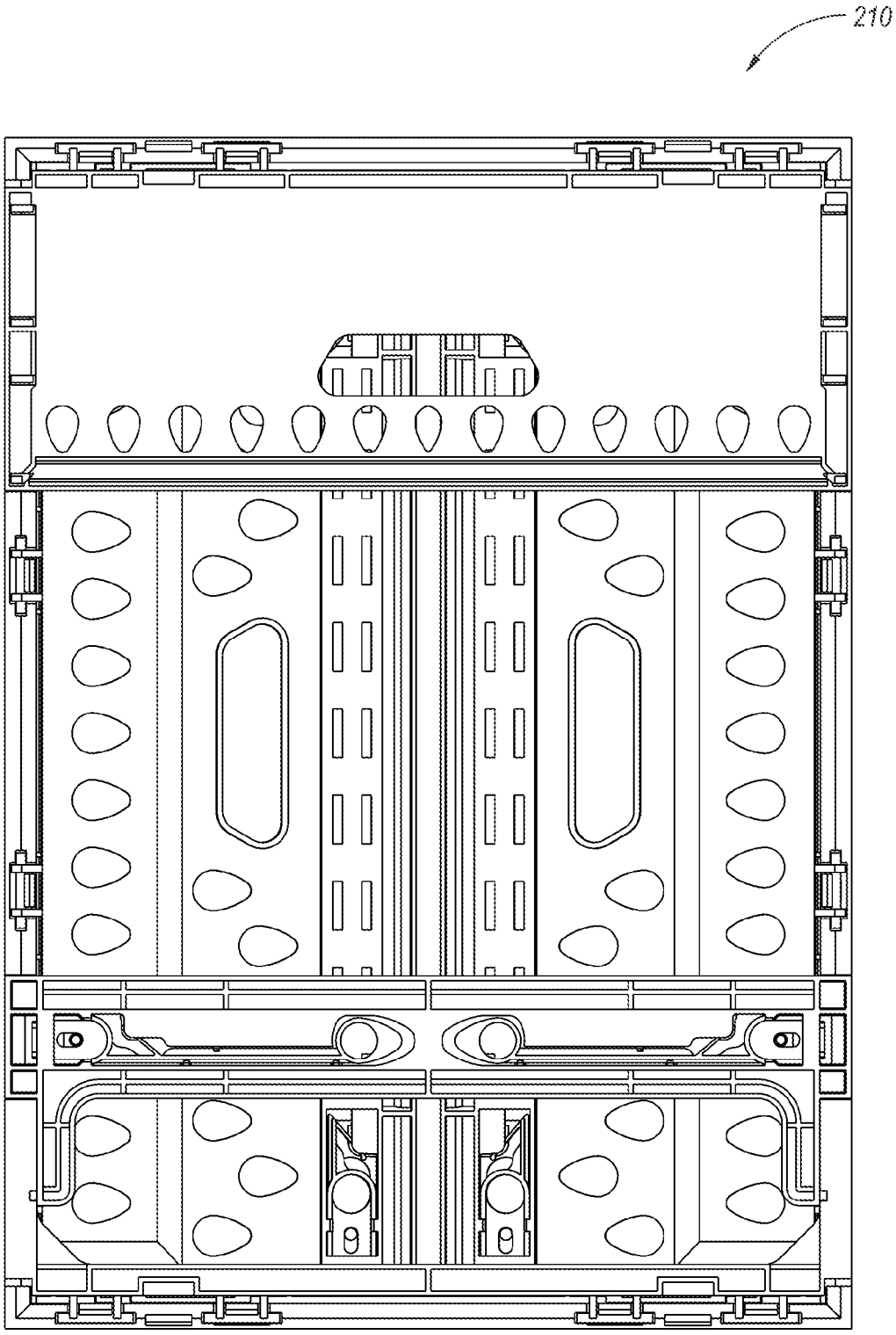
FIG. 47 is a top view of the collapsed container of FIG. 46.

FIG. 47 is a top view of the collapsed container 210 of FIG. 46.

Figure 48:
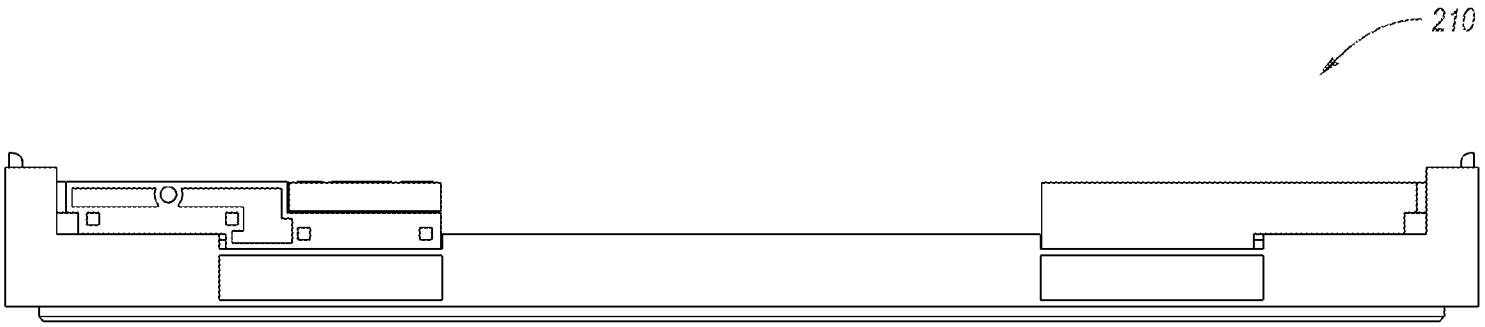
FIG. 48 is a side view of the collapsed container of FIG. 46.

FIG. 48 is a side view of the collapsed container 210 of FIG. 46.

Figure 49:
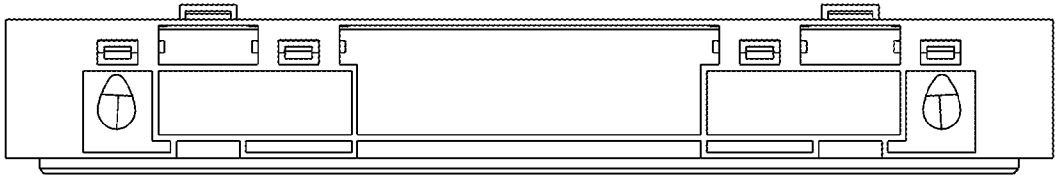
FIG. 49 is an end view of the collapsed container of FIG. 46.

FIG. 49 is an end view of the collapsed container 210 of FIG. 46.

Figures 50, 51, 52, 53:
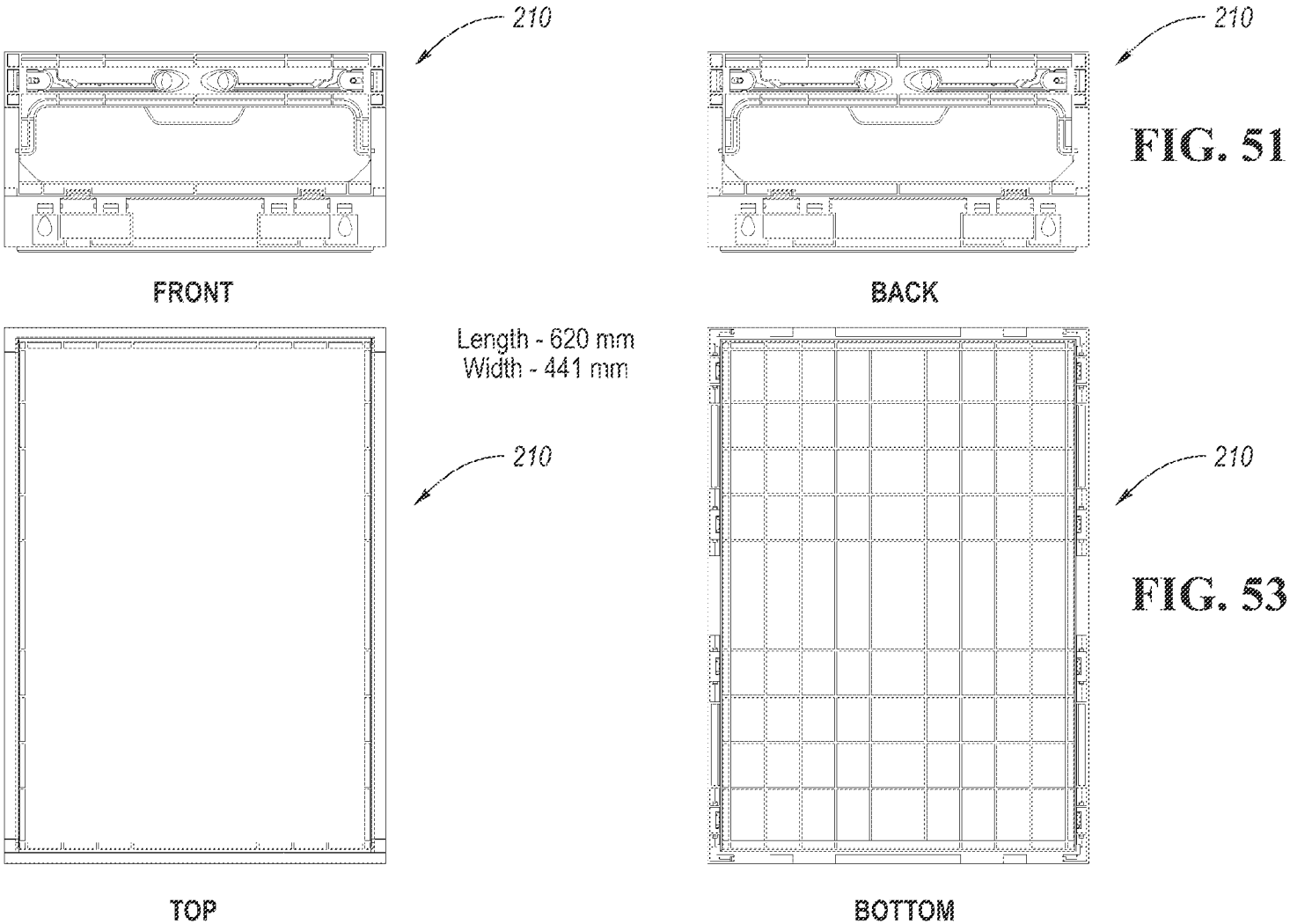
FIG. 50 is a front view of the container of FIG. 42.
FIG. 51 is an end view of the container of FIG. 50.
FIG. 52 is a top view of the container of FIG. 50.
FIG. 53 is a bottom view of the container of FIG. 52.

FIG. 50 is a front view of the container 210 of FIG. 42. FIG. 51 is an end view of the container 210 of FIG. 50. FIG. 52 is a top view of the container 210 of FIG. 50. FIG. 53 is a bottom view of the container 210 of FIG. 52.

Figure 54:
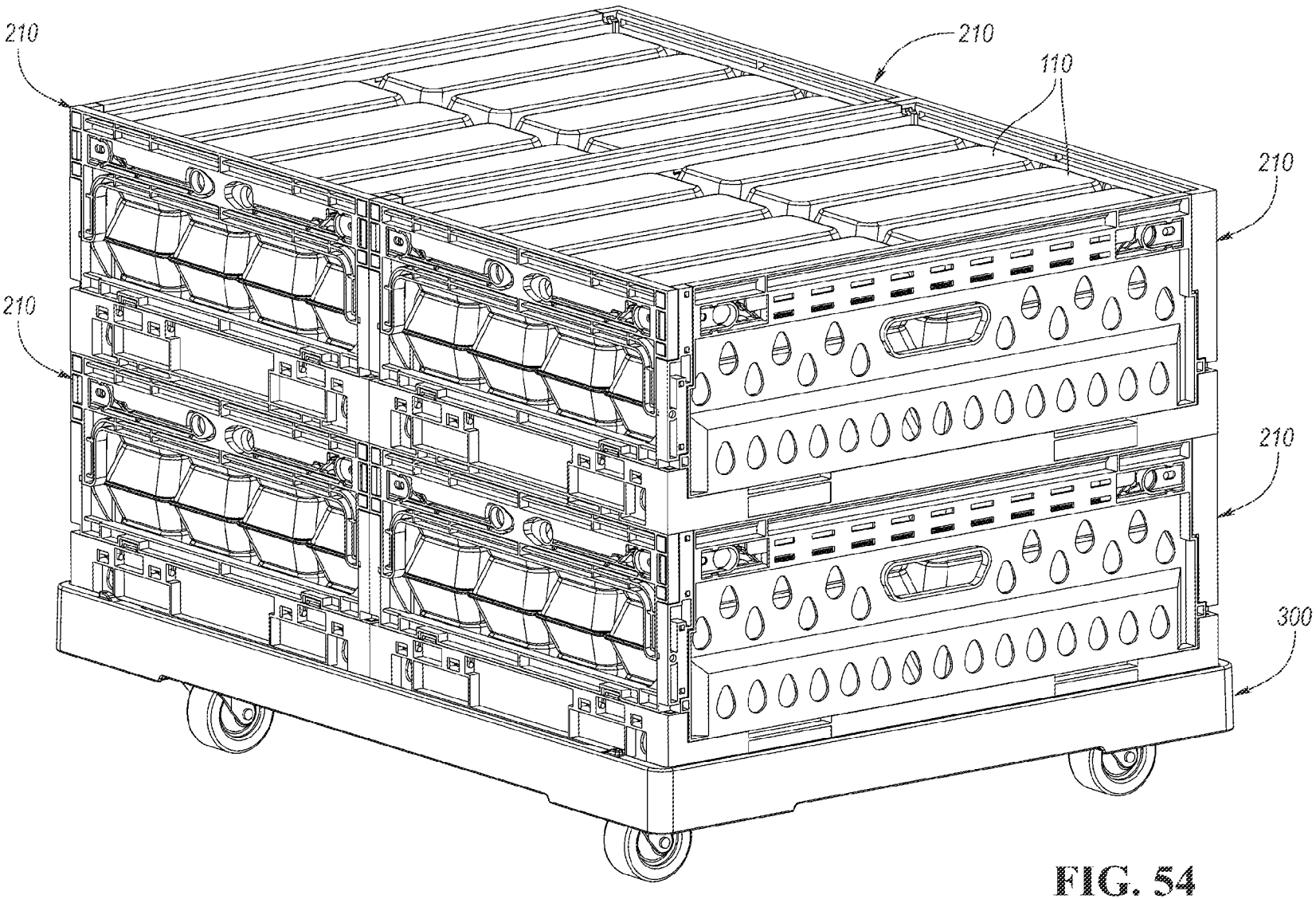
FIG. 54 is a perspective view of a plurality of loaded containers of FIG. 41 stacked together on a dolly.

FIG. 54 is a perspective view of a plurality of containers 210 stacked together on a dolly 300 and loaded with egg cartons 110.

Figure 55:
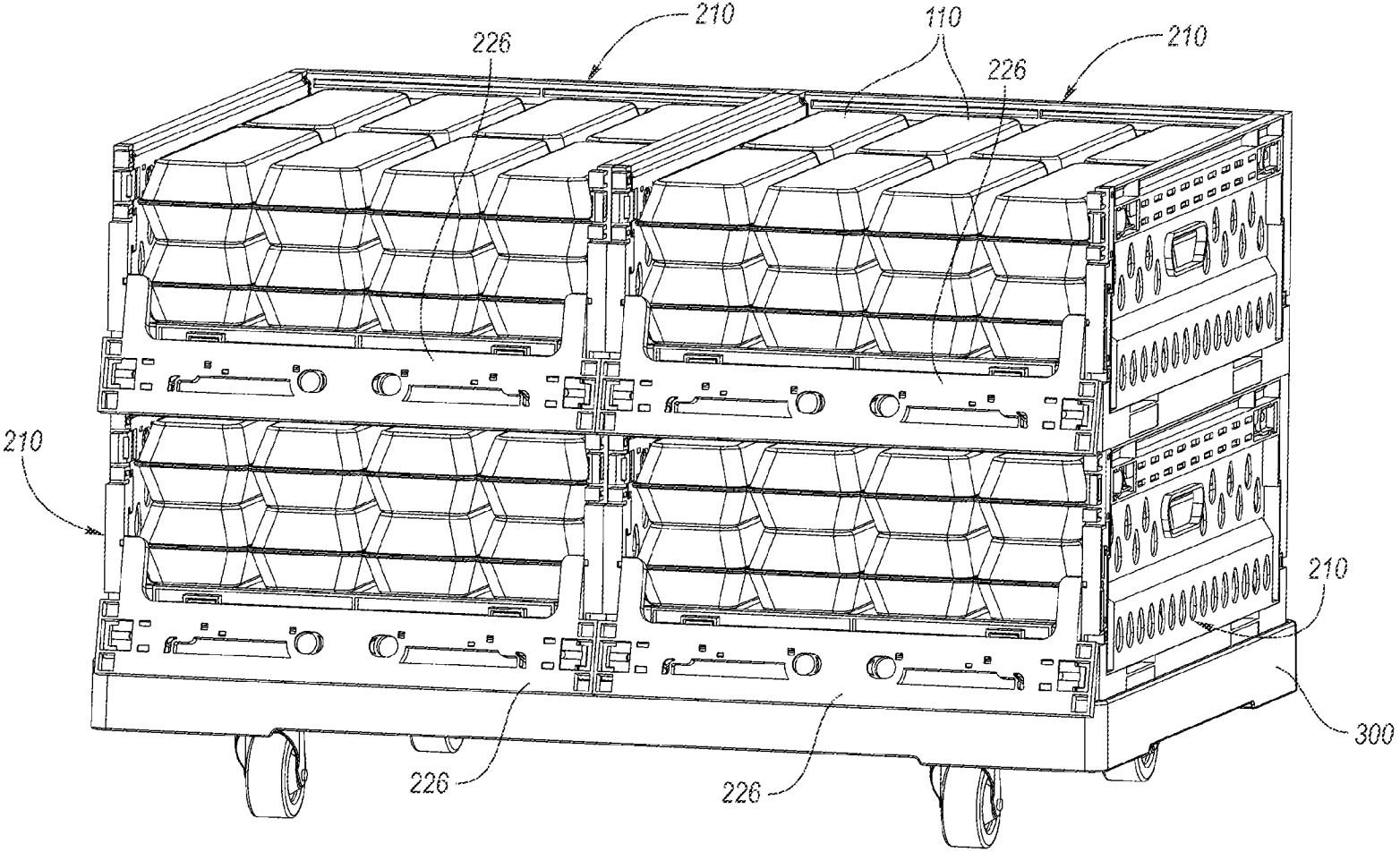
FIG. 55 shows the containers of FIG. 54 with the doors in the open position.

As shown in FIG. 55, the doors 226 of the containers 210 can be open while the containers 210 are stacked. The egg cartons 110 can be removed from the containers 110 through the openings after the doors 226 are open.

Figure 56:
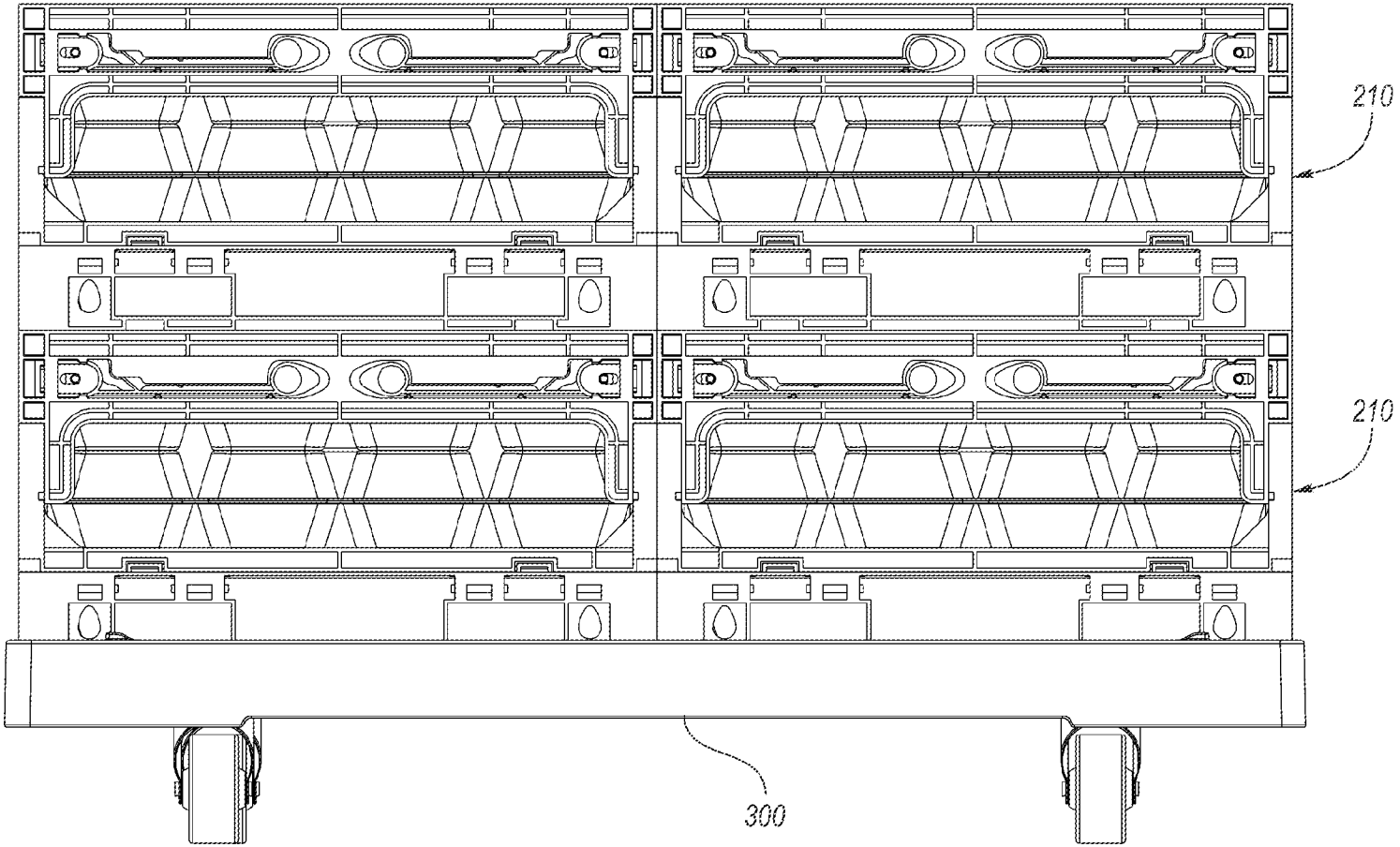
FIG. 56 is a front view of the containers of FIG. 55.

FIG. 56 is a front view of the containers of FIG. 55 with the doors 226 closed.

Figure 57:
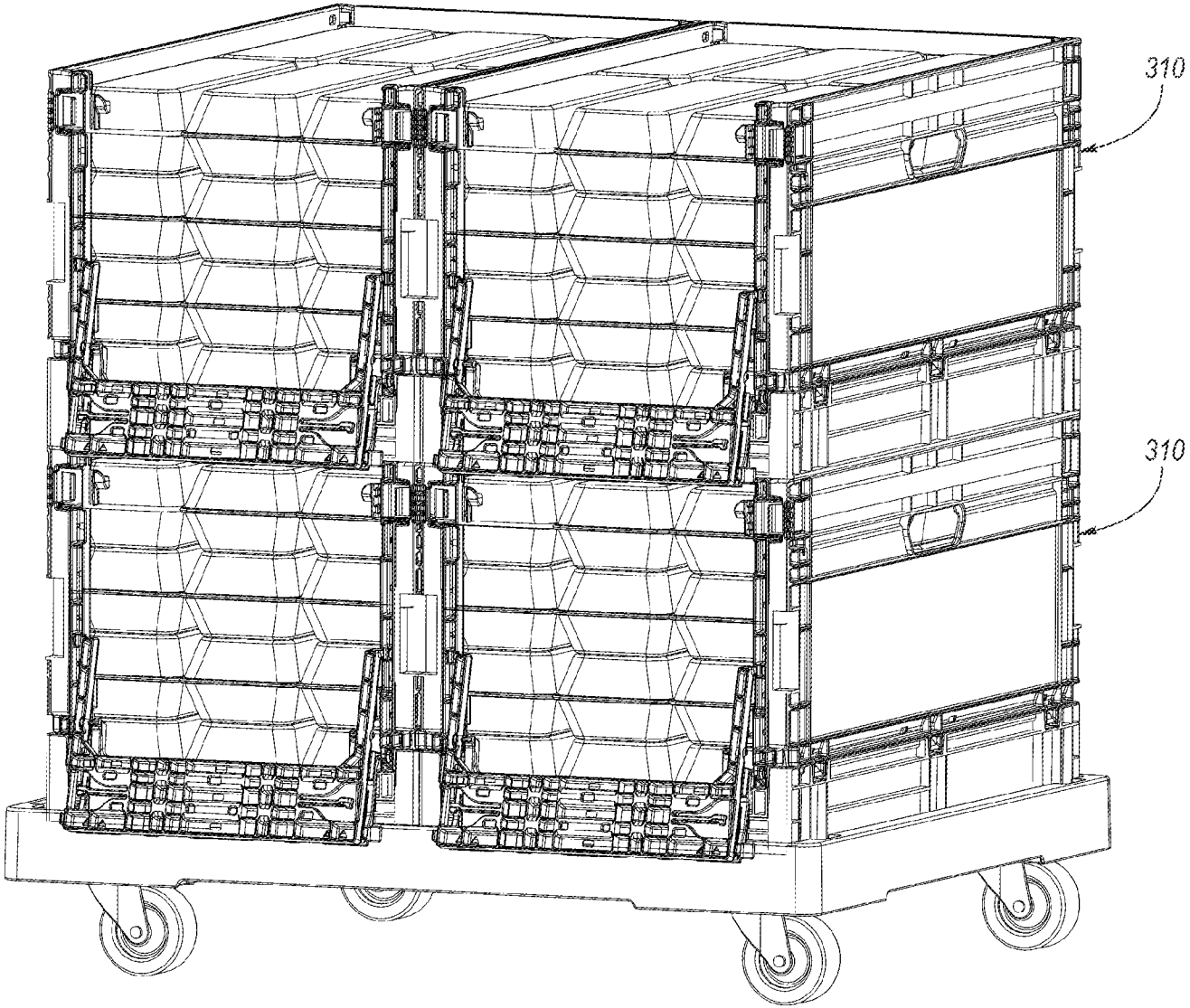
FIG. 57 shows a plurality of loaded containers according to another embodiment, stacked on a dolly.

FIG. 57 shows a plurality of loaded containers 310 according to another embodiment, stacked on a dolly. In this embodiment, the containers 310 are taller to accommodate another layer of egg cartons 110.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base;

a pair of opposed first walls pivotably connected to opposed first edges of the base; and a second wall pivotably connected to a second edge of the base, wherein the second wall is perpendicular to the first walls, wherein the second wall includes a frame including a pair of elongated vertical upstanding members each including a recess opening outward of the container in opposite directions of one another, the second wall further including a door pivotably connected to the upstanding members, the door including an upper panel portion having a pair of wing portions projecting away from one another and receivable in the outer recesses in the upstanding members.

2. The collapsible container of claim 1 wherein the door includes a pair of arms extending downward from the upper panel portion and pivotably secured to the upstanding members.

3. The collapsible container of claim 1 further including a pair of latches biased away from each other, wherein the pair of latches are mounted to the door and releasably secured to the upstanding members and releasable from the upstanding members upon movement of the latches toward one another.

4. The collapsible container of claim 3 wherein each of the latches includes at least one resilient leg biasing an interlocking portion toward one of the upstanding members.

5. The collapsible container of claim 4 wherein each of the latches includes at least one handle accessible by a user to slide the latch away from the respective upstanding member.

6. The collapsible container of claim 4 wherein each of the latches includes an inner handle portion and an outer handle portion, both of which are accessible by a user to slide the latch away from the respective upstanding member and thereby unlatch the door.

7. The collapsible container of claim 3 wherein each wing portion includes a center recess into which an interlocking portion of the respective latch is biased when the respective latch is in a latched position.

8. The collapsible container of claim 7 wherein each of the upstanding members includes a projection projecting into the respective outer recess, wherein each projection includes an interlocking recess opening toward the respective latch and receiving the interlocking portion of the respective latch when the latch is in the latched position, wherein the center recess in each wing portion receives the respective projection of the respective upstanding member when the door is in a closed position.

9. The collapsible container of claim 8 wherein the pair of latches is a pair of door latches, each of the upstanding members further including a first recess facing one of the first walls and receiving an interlocking portion of a first latch therein when the first latch is latched.

10. The collapsible container of claim 3 wherein each of the latches includes at least one handle accessible by a user to slide the latch away from the respective upstanding member and wherein each of the at least one handle is accessible from an interior side of the door and from an exterior side of the door.

11. A collapsible container comprising:

a base;

a pair of opposed first walls pivotably connected to opposed first edges of the base;

a second wall pivotably connected to a second edge of the base, wherein the second wall is perpendicular to the first walls, wherein the second wall includes a frame including a pair of elongated vertical upstanding members, the second wall further including a door pivotably connected to the upstanding members, the door including an upper panel portion; and a latch mounted in the upper panel portion of the door, the latch including at least one resilient leg biasing the latch toward one of the upstanding members to a latched position in which the door is latched to the one of the upstanding members, wherein the latch includes an inner handle portion and an outer handle portion, both of which are accessible by a user to slide the latch away from the one of the upstanding members and thereby unlatch the door.

12. The collapsible container of claim 11 wherein the door includes a pair of arms extending downward from the upper panel portion and pivotably secured to the upstanding members.

13. The collapsible container of claim 11 wherein the latch is one of a pair of latches biased away from each other, wherein the pair of latches are releasable from the upstanding members upon movement of the latches toward one another.

14. The collapsible container of claim 11 wherein the door includes a pair of wing portions projecting outward away from one another in the plane of the door, wherein the pair of wing portions includes a first wing portion having a center recess into which an interlocking portion of the latch is biased when the latch is in a latched position, wherein the first wing portion includes an outer wall defining an outer edge of the center recess and wherein the interlocking portion of the latch is biased toward the outer wall.

15. The collapsible container of claim 14 wherein the one of the upstanding members includes a projection having a recess opening toward the latch and receiving the interlocking portion of the respective latch when the latch is in the latched position, wherein the center recess in each wing portion receives the projection of the one of the upstanding members when the door is in a closed position.

16. The collapsible container of claim 15 wherein the latch is a door latch, each of the upstanding members further including a recess facing one of the first walls and receiving an interlocking portion of a first latch therein when the first latch is latched.

17. The collapsible container of claim 1 wherein each of the first walls is in a first plane perpendicular to the base and perpendicular to the second wall, wherein each of the first planes contains one of the first edges of the base, wherein each of the wing portions extends outwardly into a nearer one of the first planes.

18. The collapsible container of claim 1 wherein each of the first walls is in a first plane perpendicular to the base and perpendicular to the second wall, wherein each of the first planes contains one of the first edges of the base, wherein each of the upstanding members is in a nearer one of the first planes.

19. The collapsible container of claim 1 wherein the door can be pivoted away from the upstanding members while an identical container is stacked on the pair of first walls and the second wall.

20. The collapsible container of claim 2, wherein the wing portions project outward relative to the pair of arms.

21. A collapsible container comprising:

a base;

a pair of opposed first walls pivotably connected to opposed first edges of the base and movable between an upright position and a collapsed position, wherein each of the first walls is in a first plane perpendicular to the base when in the upright position, wherein each of the first planes contains one of the first edges of the base, wherein each of the first walls includes a latch having an interlocking portion, wherein each latch is movable in one of the first planes between a latched and unlatched position;

a second wall pivotably connected to a second edge of the base and movable between an upright position and a collapsed position, wherein the second wall is perpendicular to the first walls when the second wall and the first walls are in the upright position, wherein the second wall includes a frame including a pair of elongated vertical upstanding members extending upward from a lower bar, wherein each of the upstanding members is in one of the first planes when the first walls and the second wall are in the upright position, wherien each of the upstanding members includes a recess facing one of the first walls and configured to receive the interlocking portion of the latch of the one of the first walls, the second wall further including a door pivotably connected to the upstanding members, the door including an upper panel portion and a pair of arms extending downward from the upper panel portion, the pair of arms pivotably secured to the upstanding members; and a pair of latches biased away from each other, wherein the pair of latches are mounted to the door and releasably secured to the upstanding members and releasable from the upstanding members upon movement of the latches toward one another.

22. The collapsible container of claim 21, wherein the base includes a pair of opposed first flanges projecting upward and a second flange projecting upward, wherein the pair of opposed first walls are pivotably connected to the pair of opposed first flanges and the second wall is pivotably connect to the second flange, wherein the second flange is taller than the pair of opposed first flanges.

23. The collapsible container of claim 21, wherein the base includes a pair of opposed first flanges projecting upward and a second flange projecting upward, wherein the pair of opposed first walls are pivotably connected to the pair of opposed first flanges and the second wall is pivotably connect to the second flange, wherein the second flange is taller than the pair of opposed first flanges.

24. The collapsible container of claim 17 wherein each of the upstanding members is in one of the first planes.

25. A collapsible container comprising:

a base;

a pair of opposed first walls pivotably connected to opposed first edges of the base and pivotable between a collapsed position and an upright position, wherein each of the first walls is in a first plane perpendicular to the base when in the upright position, wherein each of the first planes contains one of the first edges of the base; and a second wall pivotably connected to a second edge of the base perpendicular to the first edges and pivotable between a collapsed position and an upright position wherein the second wall includes a frame including a pair of elongated vertical upstanding members each including a recess in one of the first planes, the second wall further including a door pivotably connected to the upstanding members, the door including an upper panel portion having a pair of wing portions projecting away from one another and receivable in the recesses in the upstanding members.

26. The collapsible container of claim 25 wherein the door includes a pair of arms extending downward from the upper panel portion and pivotably secured to the upstanding members.

27. The collapsible container of claim 26 further including a pair of latches biased away from each other, wherein the pair of latches are mounted to the door and releasably secured to the upstanding members and releasable from the upstanding members upon movement of the latches toward one another.

28. The collapsible container of claim 26 wherein each of the upstanding members includes a flange projecting rearwardly toward an adjacent one of the pair of first walls, wherein each of the first walls has a latch biased toward the adjacent flange.

* * * * *